US010816293B2

(12) United States Patent
Nieh et al.

(10) Patent No.: US 10,816,293 B2
(45) Date of Patent: Oct. 27, 2020

(54) APPARATUS, SYSTEM AND METHOD FOR REDUCING GUN VIOLENCE

(71) Applicant: Truss Technologies, Boston, MA (US)

(72) Inventors: Chun-Liang Nieh, Boston, MA (US); Delson Faria Dasilva, Natick, MA (US); Codrin Cobzaru, Iasi (RO)

(73) Assignee: Truss Technologies, Inc., Boston, MA (US)

( * ) Notice: Subject to any disclaimer, the term of this patent is extended or adjusted under 35 U.S.C. 154(b) by 0 days.

(21) Appl. No.: 16/436,150

(22) Filed: Jun. 10, 2019

(65) Prior Publication Data

US 2019/0376756 A1 Dec. 12, 2019

Related U.S. Application Data

(60) Provisional application No. 62/682,400, filed on Jun. 8, 2018.

(51) Int. Cl.

| | |
|---|---|
| ***F41A 17/46*** | (2006.01) |
| ***F41A 17/06*** | (2006.01) |
| ***F41A 17/08*** | (2006.01) |

(52) U.S. Cl.

CPC ..... *F41A 17/08* (2013.01); *F41A 17/06* (2013.01); *F41A 17/46* (2013.01)

(58) Field of Classification Search

CPC ..... F41A 17/00; F41A 17/06; F41A 17/063; F41A 17/08; F41A 17/22; F41A 17/30; F41A 17/36; F41A 17/46

See application file for complete search history.

(56) References Cited

U.S. PATENT DOCUMENTS

| | | | | |
|---|---|---|---|---|
| 338,189 A * | 3/1886 | Potter | F41A 17/52 | 42/70.06 |
| 1,024,932 A * | 4/1912 | Vander Haeghen | F41A 17/36 | 89/137 |
| 2,372,519 A * | 3/1945 | Roper | F41A 17/36 | 89/137 |
| 2,846,925 A * | 8/1958 | Norman | F41A 17/38 | 89/145 |

(Continued)

FOREIGN PATENT DOCUMENTS

| | | |
|---|---|---|
| WO | 2017151162 A1 | 9/2017 |
| WO | 2017172379 A1 | 10/2017 |

OTHER PUBLICATIONS

Grant, Ron, "Gun Protection Smart Lock" retrieved from Internet archives Jul. 9, 2019, https://web.archive.org/web/20171109113017/http://www.filmmusicarts.com/GPSLock2.html.

*Primary Examiner* — Derrick R Morgan
(74) *Attorney, Agent, or Firm* — Rhodes Donahoe, LLC; Robert V. Donhaoe

(57) ABSTRACT

A firearms operating mechanism included in a firearm. The firearms operating mechanism including a trigger bar and a compliant mechanism coupled to the trigger bar, the compliant mechanism operable in at least a first state and a second state. When the compliant mechanism is in the first state the trigger bar is positioned to operate as a part of the firearms operating mechanism to fire the firearm in response to a trigger pull. When the compliant mechanism is in the second state the trigger bar is modified such that the trigger pull is incapable of firing the firearm.

17 Claims, 12 Drawing Sheets

(56) References Cited

U.S. PATENT DOCUMENTS 3,184,876 A * 5/1965 Walther ..... F41A 17/74 42/70.08
3,608,224 A * 9/1971 Hildebrandt ..... F41A 17/46 42/70.05
4,682,435 A * 7/1987 Heltzel ..... F41A 17/063 42/70.01
5,675,925 A * 10/1997 Wurger ..... F41A 17/06 42/70.06
6,223,460 B1 * 5/2001 Schmitter ..... F41A 17/46 42/70.06
6,237,271 B1 * 5/2001 Kaminski ..... F41A 17/063 42/70.01
6,240,669 B1 * 6/2001 Spaniel ..... F41A 17/36 42/70.02
6,253,479 B1 * 7/2001 Fuchs ..... F41A 17/36 42/70.02
6,457,271 B1 * 10/2002 Vaid ..... F41A 17/36 42/11
6,588,136 B2 * 7/2003 Baker ..... F41A 19/48 42/70.02
6,823,621 B2 * 11/2004 Gotfried ..... F41A 17/066 42/70.01
6,952,895 B1 * 10/2005 Zonshine ..... F41A 17/36 42/18
7,356,959 B2 * 4/2008 Schmitter ..... F41A 17/063 42/70.01
8,127,482 B2 3/2012 O'shaughnessy et al.
8,312,660 B1 * 11/2012 Fujisaki ..... F41A 17/08 42/70.01
8,549,780 B2 * 10/2013 Emde ..... F41A 17/063 42/70.01
8,850,944 B2 10/2014 Zhou
8,966,797 B2 * 3/2015 Carlson ..... F41A 17/063 42/1.01
9,115,944 B2 8/2015 Arif et al.
9,175,915 B2 11/2015 Harvey
9,222,743 B1 * 12/2015 Shah ..... F41A 17/46
9,250,030 B2 2/2016 Henry
9,261,315 B2 2/2016 Travis
9,316,454 B2 * 4/2016 Milde, Jr. ..... F41A 17/066
9,341,425 B2 5/2016 Carlson
9,341,443 B2 5/2016 Chukwu
9,354,011 B2 * 5/2016 Cooke ..... F41A 17/063
9,395,132 B2 7/2016 Stewart et al.
9,400,150 B2 7/2016 Stewart et al.
9,404,698 B2 8/2016 Stewart et al.
9,435,597 B2 9/2016 Goren et al.
9,470,485 B1 10/2016 Kley
9,599,418 B2 3/2017 Steele
9,628,470 B2 4/2017 Mori
9,644,911 B1 5/2017 Mclean, III
9,651,325 B1 * 5/2017 Gant ..... F41A 17/066
9,658,012 B2 5/2017 Stewart et al.
9,658,013 B2 5/2017 Stewart et al.
9,704,132 B2 7/2017 Fraccaroli
9,746,266 B1 8/2017 Barido et al.
9,810,497 B2 11/2017 Carlson
9,863,731 B1 * 1/2018 Alderman ..... F41A 19/09
9,921,017 B1 3/2018 Kley
10,001,335 B2 * 6/2018 Patterson ..... F41A 17/56
10,107,583 B2 10/2018 Stewart et al.
2001/0016998 A1 * 8/2001 Chapman ..... F41A 17/46 42/69.01
2001/0042332 A1 * 11/2001 Gering ..... F41A 17/063 42/70.08
2002/0116857 A1 * 8/2002 Wonisch ..... F41A 3/64 42/75.02
2002/0194762 A1 * 12/2002 Cominolli ..... F41A 17/72 42/70.06
2003/0097776 A1 * 5/2003 Brosow ..... F41A 17/063 42/70.01
2005/0279165 A1 * 12/2005 Yuasa ..... G01P 15/123 73/489
2006/0242879 A1 * 11/2006 Schmitter ..... F41A 17/063 42/70.01
2007/0186457 A1 * 8/2007 Pitt ..... F41A 17/46 42/70.06
2012/0090213 A1 * 4/2012 Pichler ..... F41A 17/46 42/70.06
2012/0180357 A1 * 7/2012 Dietel ..... F41A 17/08 42/70.06
2014/0366420 A1 * 12/2014 Hager ..... F41A 17/063 42/70.11
2015/0027020 A1 * 1/2015 Sheets, Jr. ..... F41A 17/46 42/70.11
2015/0253109 A1 * 9/2015 Wichner ..... G01B 17/00 434/19
2015/0345887 A1 * 12/2015 Shneorson ..... F41A 17/08 89/28.1
2016/0084599 A1 * 3/2016 Alicea, Jr. ..... F41A 17/46 42/70.06
2016/0252317 A1 * 9/2016 Biran ..... F41A 17/38 42/1.01
2016/0320154 A1 * 11/2016 Krieger ..... F41A 17/64
2017/0077741 A1 * 3/2017 Winiecki ..... H02J 50/10
2017/0241727 A1 8/2017 Stewart et al.
2017/0241728 A1 8/2017 Stewart et al.
2018/0058786 A1 3/2018 Carlson
2018/0156566 A1 * 6/2018 Wei ..... F41B 11/89
2018/0164060 A1 * 6/2018 Alok ..... F42B 5/08
2018/0268119 A1 9/2018 Nicoll
2018/0274872 A1 * 9/2018 Zukowski ..... F41A 17/20
2018/0299220 A1 10/2018 Du et al.
2019/0025000 A1 * 1/2019 Bascom ..... F41A 33/06
2019/0195585 A1 * 6/2019 Rensing ..... G01S 19/14
2019/0226785 A1 * 7/2019 Delgado Acarreta ... F41A 17/46
2019/0310042 A1 * 10/2019 Himmich ..... F41A 17/08
2019/0376756 A1 * 12/2019 Nieh ..... F41A 17/063
2020/0025488 A1 * 1/2020 Alicea, Jr. ..... F41A 19/69
2020/0041224 A1 * 2/2020 Makarov ..... F41A 9/61

* cited by examiner

APPARATUS, SYSTEM AND METHOD FOR REDUCING GUN VIOLENCE

BACKGROUND OF INVENTION

1. Field of Invention

This invention relates generally to systems, apparatus and methods for reducing gun violence. More specifically, at least one embodiment, relates to systems, apparatus and methods to lock the trigger of firearms located within pre-defined geographic zones.

2. Discussion of Related Art

Today's epidemic of gun violence in the U.S. is highlighted by the number of shootings that have occurred at schools around the country. Mass shootings are also occurring with increasing frequency in public venues. Smart guns are often held out as a solution to the problem, for example, guns that include biometric sensors or require the user to wear some form of electronic device to authenticate the user as the owner of the gun. However, these solutions are ineffective because a legal gun owner can still purchase such a firearm and use it to harm others without restriction. Further, proposals for smart gun technology do not get any traction among gun owners or gun manufacturers.

Other approaches generally refer to the use of GPS to restrict gun use. However, such approaches have not considered the hardware design of such technology nor the demands placed on electronic hardware included in a firearm. For example, these approaches require operation of an electronic system included in a gun but fail to address battery life where a battery is the source of power required for operation of the trigger lock. These approaches also fail to address circumstances in which a GPS signal is unavailable.

Further, the operation of such systems when included in police firearms is not fully addressed. For example, prior approaches do not provide for any system by which firearms can be selectively made active in an otherwise locked-down area.

One GPS based approach employs technology to restrict the use of a firearm to a small geographic area, for example, the gun owner's home. However, these approaches create such a limited zone of use they do not offer a solution that is acceptable to the vast majority of gun owners.

SUMMARY OF INVENTION

Therefore, there is a need for approaches to establish geographic areas (or zones) in which unauthorized firearms cannot be used. Systems, apparatus and methods described herein provide approaches for the preceding while maintaining firearms in an operational state when located outside these zones. Some embodiments described herein provide battery recharging that occurs automatically when the firearm is used, for example, at a target range. Further embodiments provide an approach in which firearms can be logged for use in a restricted firearms zone, for example, firearms used by police officers or other authorized security personnel.

According to one aspect, a firearm includes an electronic trigger lock system with an integral power source. In various embodiments, the system automatically generates power to charge the power source during a conventional operation of the firearm. According to one embodiment, the power generation occurs when the slide of a semi-automatic pistol cycles. In a further embodiment, the power generation occurs when either the user manually cycles the slide or the slide operates when the firearm is fired. Various embodiments provide a tamper-proof design of the electronic trigger lock system.

According to another aspect, a combination of GPS and RF are employed to establish a pre-defined zone of restricted firearms use. In some embodiments, GPS is employed as a primary technology used to establish such a zone. However, applicants find that system reliability is improved when an RF transmitter is located in the zone. The RF transmitter communicates a signal that is also received by the electronic trigger lock system in any firearm within a known radius of the transmitter. Should the GPS system be rendered inoperative for any reason (including an attack on GPS service) the RF transmitter provides an independent means of keeping the zone free of unauthorized firearms use.

According to one aspect, a locking mechanism is configured to render a firearm inoperable where the firearm includes a firearm operating mechanism that couples a trigger to a firing pin included in the firearm. In some embodiments, the locking mechanism includes a compliant mechanism coupled to the firearm operating mechanism, the compliant mechanism operable in at least a first state and a second state. In further embodiments, with the compliant mechanism in the first state the compliant mechanism is positioned to operate as a part of the firearm operating mechanism such that the firearm will fire in response to a trigger pull. With the compliant mechanism in a second state, the firearm operating mechanism is modified such that the trigger pull is incapable of firing the firearm. According to one embodiment, the compliant mechanism is included in a trigger bar of the firearm operating mechanism. According to another embodiment, the locking mechanism includes an electronic system coupled to the compliant mechanism and configured to respond to a wireless signal, wherein the electronic system operates to place the compliant mechanism in the second state in response to the wireless signal indicting that the firearm should be rendered inoperable. According to still another embodiment, the electronic system includes at least one of an inertial navigation system and a GPS system, and the wireless signal is received as a result of geographic location of the firearm.

According to another aspect, an apparatus configured for inclusion in a firearm includes a mechanical firearms lock; an electronic system including a power source, the electronic system coupled to the mechanical firearms lock, the electronic system operable to render the firearm inoperable based on a location of the firearm; and a power generation element configured to generate electrical power as a result of operation of the firearm, the electrical power employed by the electronic system.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
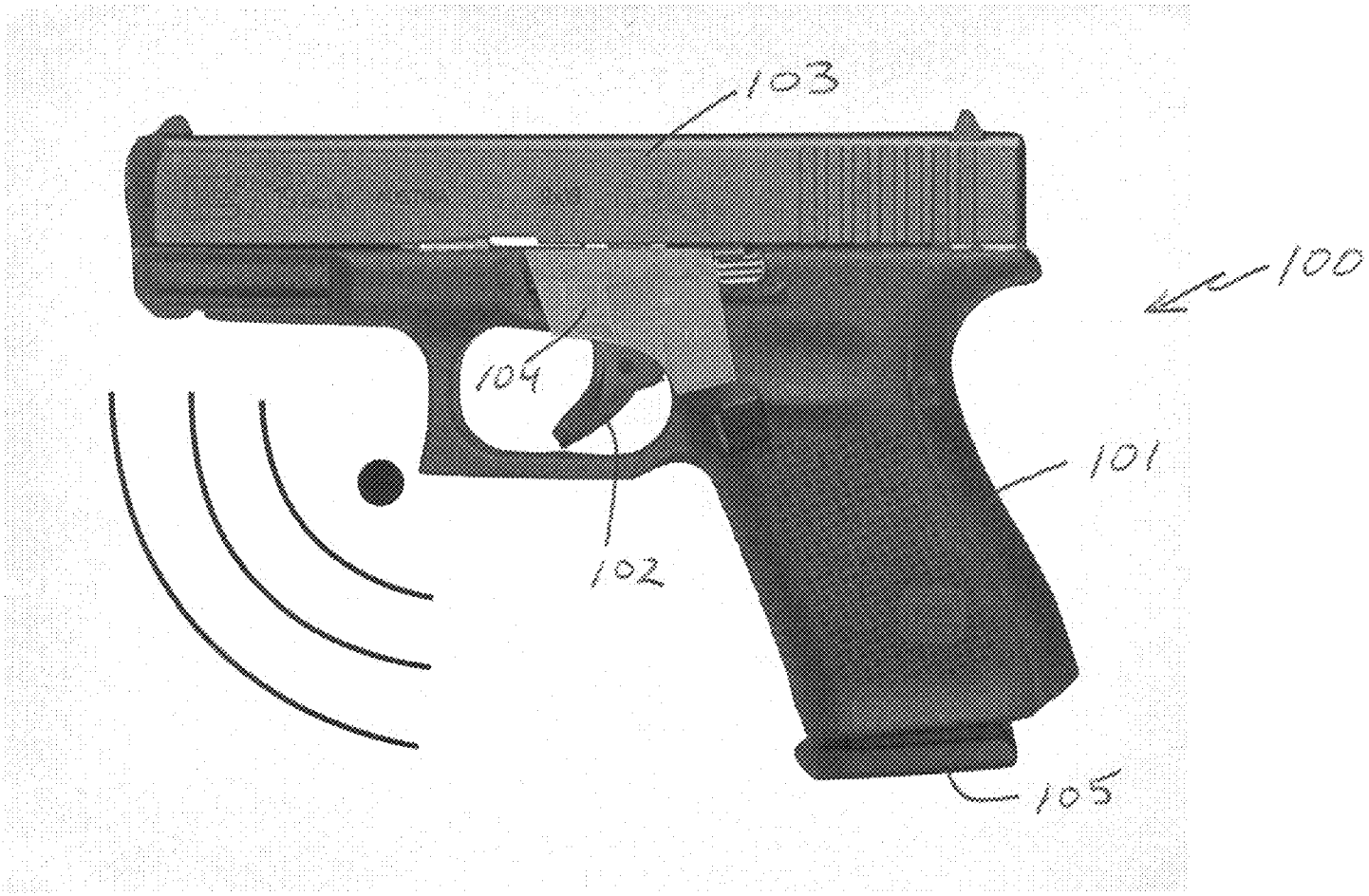
FIG. 1 illustrates a handgun including an electronic trigger lock system in accordance with one embodiment.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

FIG. 1 illustrates a handgun 100 in accordance with one embodiment. In the illustrated embodiment, the handgun 100 is a semi-automatic pistol. The handgun 100 includes a grip 101, a trigger 102, a slide 103 and a magazine 105. Cartridges including a bullet and powder stored in a case are individually loaded into the magazine 105. The magazine 105 is then inserted within the grip 101 to store the cartridges where they can be fed into the firing chamber. In general, once loaded, the handgun 100 operates to fire a bullet when the trigger is pulled. When each bullet is fired, the slide 103 overcomes the forward bias of a spring integral to the handgun and moves rearward to eject the spent cartridge case and cock the hammer. The operation of the slide is completed when a spring returns the slide to the at rest position shown in FIG. 1 to push a cartridge stored in the magazine into the chamber. The preceding operation occurs in a split second. When complete the handgun is ready to fire another bullet.

The handgun 100 illustrated in FIG. 1 also includes an electronic trigger lock system 104. In general, the electronic trigger lock system 104 renders the handgun 100 incapable of firing a shot when the handgun 100 is located within a predetermined zone and/or at a predetermined location. While illustrated as a component of a semi-automatic pistol, those of ordinary skill in the art will recognize that the electronic trigger lock system 104 can be employed with any type of firearm that includes a trigger.

Figure 2:
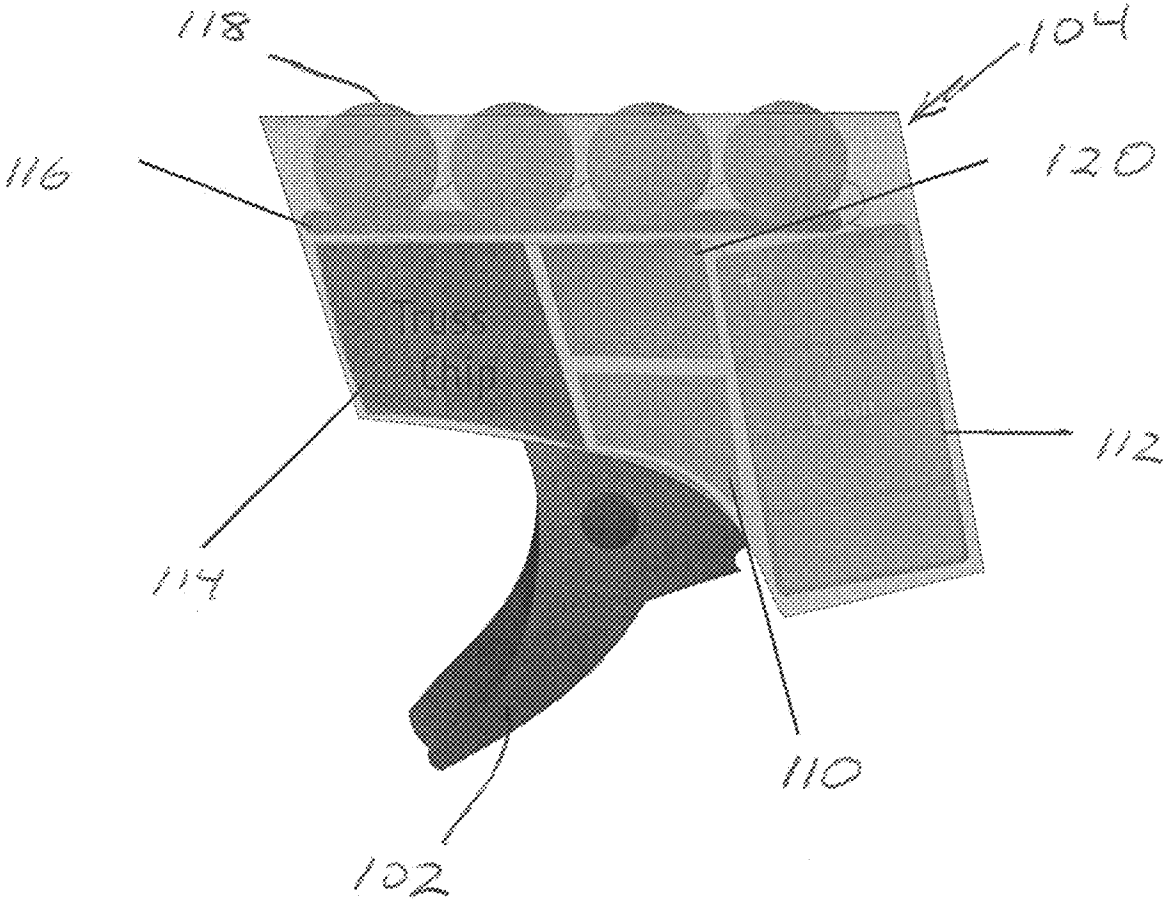
FIG. 2 illustrates details of the electronic trigger lock system of FIG. 1 in accordance with one embodiment.

Referring now to FIG. 2, details of the electronic trigger lock system 104 are illustrated in accordance with one embodiment. According to the illustrated embodiment, the electronic trigger lock system 104 includes a trigger lock 110, a power source 112, a processor 114, a voltage regulator 116, at least one motor 118 and a voltage converter 120.

The trigger lock 110 can be provided in any one of a plurality of configurations depending on the embodiment. For example, the trigger lock 110 employs a solenoid-operated linear actuator in accordance with one embodiment. In this embodiment, a plunger included in the solenoid is moved between a first position (or "state") in which the trigger 102 operates freely to a second position (or state) in which movement of the trigger 102 is blocked. A voltage is applied to energize a coil included in the solenoid and operate the plunger. A proximate end of the plunger is located within the body of the solenoid during operation while the distal end is exposed such that it engages the firing mechanism (for example, the trigger 102) of the handgun 100. According to one embodiment, the default position of the trigger lock 110 is a "live" position in which the handgun is operational in a conventional fashion. According to this embodiment, the solenoid is energized to lock-out the handgun and prevent use. According to another embodiment, the two "states" are reversed such that the default position of the trigger lock 110 is the locked position in which the handgun 100 cannot fire a shot. According to this alternate embodiment, the solenoid is energized to unlock the handgun 100 for use. In some embodiments, a limited amount of current is required to maintain the solenoid in an energized state. However, the holding current is substantially less than the inrush current required to operate the device to move the trigger lock from the default position to the second position.

According to other embodiments, a latching solenoid is employed such that the solenoid included in the trigger lock 110 is held in the locked state using a mechanical force rather than an electrical current. These embodiments avoid the need to apply a holding current to maintain the firearm in any one state. Instead, energy is only applied momentarily to unlatch the trigger lock 110 and operate the solenoid to change state between the locked state and the unlocked state.

In an alternate embodiment, the trigger lock 110 employs a rotary actuator. According to this embodiment, the rotary actuator operates in a fashion similar to a servo-motor to switch between the first state and the second state. Mechanical hardware coupled to the rotor is employed to interact with the trigger 102 and/or other element of the firing mechanism to block operation of the handgun when in the second state. According to another embodiment, a micro-electromechanical system ("MEMS") actuator is employed.

The mechanical connection between the trigger lock 110 and the trigger 102 can vary depending on the embodiment. For example, where a linear actuator is used, the distal end of the plunger can move into contact with the trigger 102 internal to the handgun 100 to lock the handgun. According to one embodiment, the plunger creates an obstruction that prevents any movement of the trigger 102.

The power source 112 can include one or more batteries, for example, lithium or alkaline batteries. Further, the power source 112 includes a rechargeable power source in various embodiments.

Depending on the embodiment, the term "processor" as used herein can refer to either a microcontroller in a conventional sense or more generally a processing device that includes I/O or other components to provide specialized functionality such as wireless communication, other RF signal processing and/or location based services as some examples. Accordingly, the processor and other aspects can be implemented with specially-programmed, special purpose hardware, for example, an application-specific integrated circuit (ASIC). Further, aspects of the invention can be implemented in software, hardware or firmware or any combination thereof. Such methods, acts, apparatus, systems, system elements and components thereof may be implemented as part of the processor described herein or as an independent component or components included in the electronic trigger lock system 104. According to some embodiments, the processor 114 includes a microcontroller.

Thus, the processor 114 can be a standalone element or, for example, be included in another component included in the electronic trigger lock system 104. In various embodiments, the processor 114 includes an internal memory configured to store software instructions for execution to implement various features and functionality described herein.

As mentioned above, the electronic trigger lock system 104 includes memory. In one embodiment, the memory is included in the processor 114. In other embodiments, the memory includes memory internal to the processor 114 and memory external to the processor 114 such as RAM, ROM, FLASH or EEPROM as some examples.

In some embodiments, the processor 114 includes a communication system. According to one embodiment, the communication system provides for local wireless communication via BLUETOOTH communication and/or long-distance communication, for example, via cellular and/or satellite communication networks. According to a further embodiment, the communication system includes an RF receiver configured to receive an RF signal transmitted by an RF transmitter to activate the trigger lock 110 of guns within receiving distance of the RF transmitter. According to still another embodiment, the processor 114 includes a GPS receiver configured to receive GPS signals employed by the electronic trigger lock system 104 to identify the location (i.e., GPS coordinates) of the handgun 100. According to a still further embodiment, the processor 114 includes each of the RF receiver and the GPS receiver. According to one embodiment, the processor 114 includes a communication system employed to wirelessly communicate the location (for example, GPS coordinates) of the handgun 100 to remote resources.

While the preceding paragraph describes the inclusion of either or both of the RF receiver and the GPS receiver in the processor 114, either or both of these elements can be provided as separate components, respectively, of the electronic trigger lock system 104. For example, each of the RF receiver and the GPS receiver can be standalone components, respectively, that are in communication with the processor 114.

According to one embodiment, the communication system provides BLUETOOTH communication suitable for transmission of information between the electronic trigger lock system 104 and a portable electronic device (for example, a mobile phone, tablet, etc.) located proximate to the handgun 100. According to this embodiment, a user can employ the electronic trigger lock system 104 in combination with a mobile phone to store user settings and data. According to one embodiment, communication between the electronic trigger lock system 104 and a user's portable electronic device is employed to update the software included in the electronic trigger lock system 104, for example, firmware for the processor 114.

According to some embodiments, the at least one motor 118 includes a plurality of small form factor AC motors. In alternate embodiments, the at least one motor 118 includes a plurality of small form factor DC motors. According to one embodiment, the at least one motor 118 is located to engage the slide 103 of the handgun 100 as is described in greater detail with reference to FIG. 3. According to this embodiment, the at least one motor 118 operates as an electrical generator.

In various embodiments, the voltage regulator 116 is employed to provide a fixed output voltage employed by the electronic trigger lock system 104. In one embodiment, the voltages are AC voltages. In another embodiment, the voltages are DC voltages. According to the illustrated embodiment, an input of the voltage regulator 116 is connected to the at least one motor 118. In this configuration, the power supplied by the at least one motor 118 is received by the voltage regulator 116 and converted to a constant output voltage despite any variability of the power supplied by the at least one motor 118.

According to one embodiment, the voltage converter 120 includes a transformer to adjust the voltage from a first voltage level to a second voltage level. For example, the transformer can step the AC voltage produced by the at least one motor 118 up or down depending on the embodiment. According to another embodiment, the voltage converter 120 included in the electronic trigger lock system 104 includes a DC to DC converter employed to convert power provided by the voltage regulator 116 at a first DC voltage to a second DC voltage that is employed by other elements included in the electronic trigger lock system 104. In various embodiments, an output of the voltage converter 120 can be coupled to a power bus included in the electronic trigger lock system 104.

In various embodiments, the components included in the electronic trigger lock system 104 are connected to the power bus for a source of operating voltage and current. Further, an internal communication bus may be employed to allow the various devices and/or circuitry included in the electronic trigger lock system 104 to communicate with one another. The communication bus can be used for the communication of instructions/commands and data between the illustrated components and between the illustrated components and other components included in the system 104 depending on the embodiment. For example, a signal controlling an operation of the trigger lock 110 can be communicated from the processor 114 to the trigger lock 110 via the communication bus.

According to further embodiments, the electronic trigger lock system 104 includes RFID. In some embodiments, the RFID system is employed to communicate the unique identification of the handgun 100.

According to some embodiments, the electronic trigger lock system 104 includes a user interface. For example, the user interface can communicate information concerning the operating status of the electronic trigger lock system 104 to the gun owner. For example, the user interface can provide a charge indication to allow the user to know the charge-status of a battery power source included in the electronic trigger lock system 104. Further, the user interface can allow the user a limited ability to control some operations of the electronic trigger lock system 104 provided that they do not allow the user to override the trigger locking functionality of the system 104. For example, the user interface can include an input that the user employs to activate wireless communication. Depending on the embodiment, the user interface can include one or a combination of switches, knobs, dials, buttons, sliders or other user adjustable inputs.

According to some embodiments, a user interface is provided for display in the user's portable electronic device such as a phone or tablet. For example, in one embodiment, the user has the ability to remotely lock the firearm with the electronic trigger lock system 104 via an application that includes a user interface displayed on their smartphone or tablet.

According to one embodiment, the electronic trigger lock system 104 includes an electrical connection (for example, a port) that is used to connect the electronic trigger lock system 104 to a source of electrical power for recharging the power source 112.

According to various embodiments, the electronic trigger lock system 104 is an element in a larger system with cloud-based resources that are hosted remote from the handgun 100. These remote resources can include servers, databases, communication systems and location based services among some examples. The remote resources can receive inputs to establish areas of restricted firearms use. For example, public safety officials in a city or town can establish a user account using these resources. As one example, these officials identify school zones in their community and provide the GPS coordinate(s) to establish a "safe" zone in the vicinity of each school where firearms use is restricted to public safety officers.

According to these embodiments, the location based services can include resources employed to receive and process GPS location information from the handgun 100. The remote resources process the information to determine whether the handgun 100 is located in an area of restricted firearms use. If the handgun 100 is located at such a location, the remote resources can communicate a signal to the electronic trigger lock system 104 to activate the trigger lock and render the handgun 100 inoperable. The location based services can also include signals communicated to the electronic trigger lock system 104 to render the handgun 100 operable when it exits the restricted location.

In various embodiments, a conventional operation of the firearm automatically generates electricity employed to operate the electronic trigger lock system. For example, where the default state maintains the firearm in the locked state, a discharged power source renders the firearm inoperative. However, the ability to manually charge the power source by cycling the firearm's operating mechanism provides the user with an ability to recharge the power source without firing a shot. Once recharged, the electronic trigger lock system operates to permit use provided that the user is not in a restricted area, for example, a geo-fenced area. Operation of the slide mechanism of a semi-automatic pistol provides one approach that can be employed for power generation. However, other types of firearms and operating mechanisms can include similar power generation capabilities. For example, operation of a pump shotgun, a revolver or a lever action gun can also be employed to charge the power source included in the electronic trigger lock system. Where the system is included in a revolver, a motor can be integrated into the revolver such that the spinning (or rotary motion) of the cylinder generates electricity. According to one embodiment, the motor is included as an integral part of the cylinder. In an alternate embodiment, the motor is included in the grip of the revolver.

Figure 3:
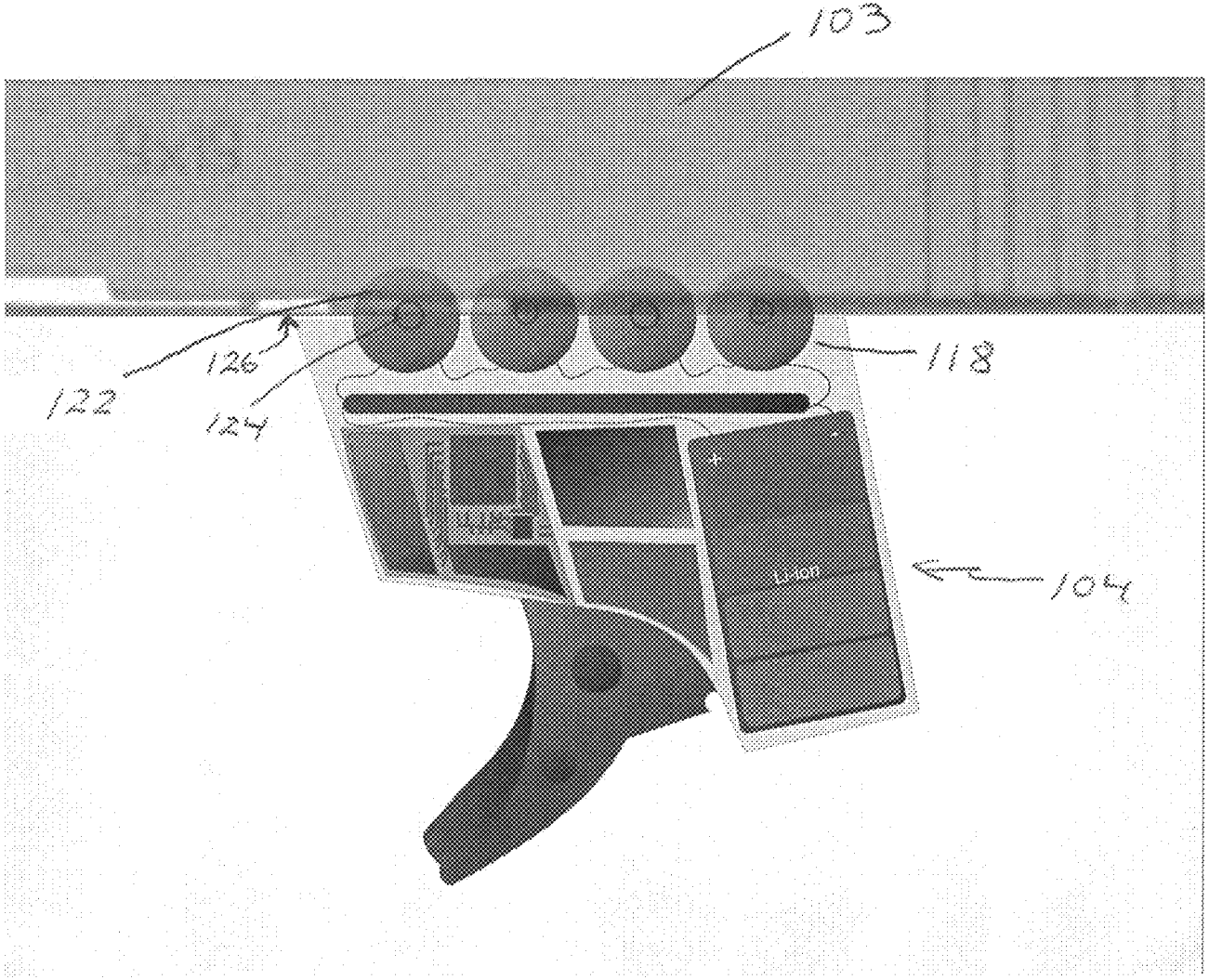
FIG. 3 illustrates details of the electronic trigger lock system of FIG. 2 when installed in a semi-automatic pistol in accordance with one embodiment.

Referring now to FIG. 3, a close-up view of the electronic trigger lock system 104 is illustrated with the trigger lock system 104 installed in the handgun 100. According to the illustrated embodiment, the handgun is a semi-automatic pistol including the slide 103. As described above, the slide 103 moves backward and forward to cycle the operation of the handgun 100. According to the embodiment illustrated in FIG. 3, the electronic trigger lock system 104 is coupled to the slide 103. The action of the slide 103 operates one or more elements included in the trigger lock system 104 to generate electrical power to recharge the power source 112.

According to the illustrated embodiment, each motor included in the at least one motor 118, respectively, is an AC motor that includes a stator 122 and a rotor 124. According to another embodiment, the at least one motor 118, respectively, is a DC motor that includes the stator 122 and the rotor 124. In general, the slide 103 includes a mechanical connection to each rotor 124.

According to one embodiment, the slide 103 and the at least one motor 118 are connected via a friction-based sliding engagement between the slide 103 and the rotor 124. In one embodiment, the rotor 124 includes a component located at a distal end of the rotor 124 for engagement with the slide 103. In other embodiments, the slide 103 makes a direct connection with the rotor 124 itself without any additional component(s). For example, the slide 103 can include an engagement surface 126 located such that the engagement surface contacts an upper portion of each rotor 124. With the friction-based contact between the engagement surface 126 and each rotor 124 the linear travel of the slide is transferred to rotary motion of the rotor. As each rotor spins the armature included in the motor rotates to generate electrical power at the output of the motor.

Other approaches can be employed to connect each rotor 124 to the slide 103. For example, a gear can be installed at or near the distal end of the rotor. According to this embodiment, the engagement surface 126 can include a series of teeth sized and located to engage the gear(s) included in the at least one motor 118. Here too, the linear travel of the slide 103 is transferred to rotary motion of the rotor. According to another embodiment, the slide 103 includes a horizontal slot that receives a distal end of each rotor within it. The interior of the slot can provide a sliding friction-based engagement with the rotors 124. Alternatively, the interior of the slot can include a series of teeth that mesh with the toothed gears located on the rotors 124.

Figure 4:
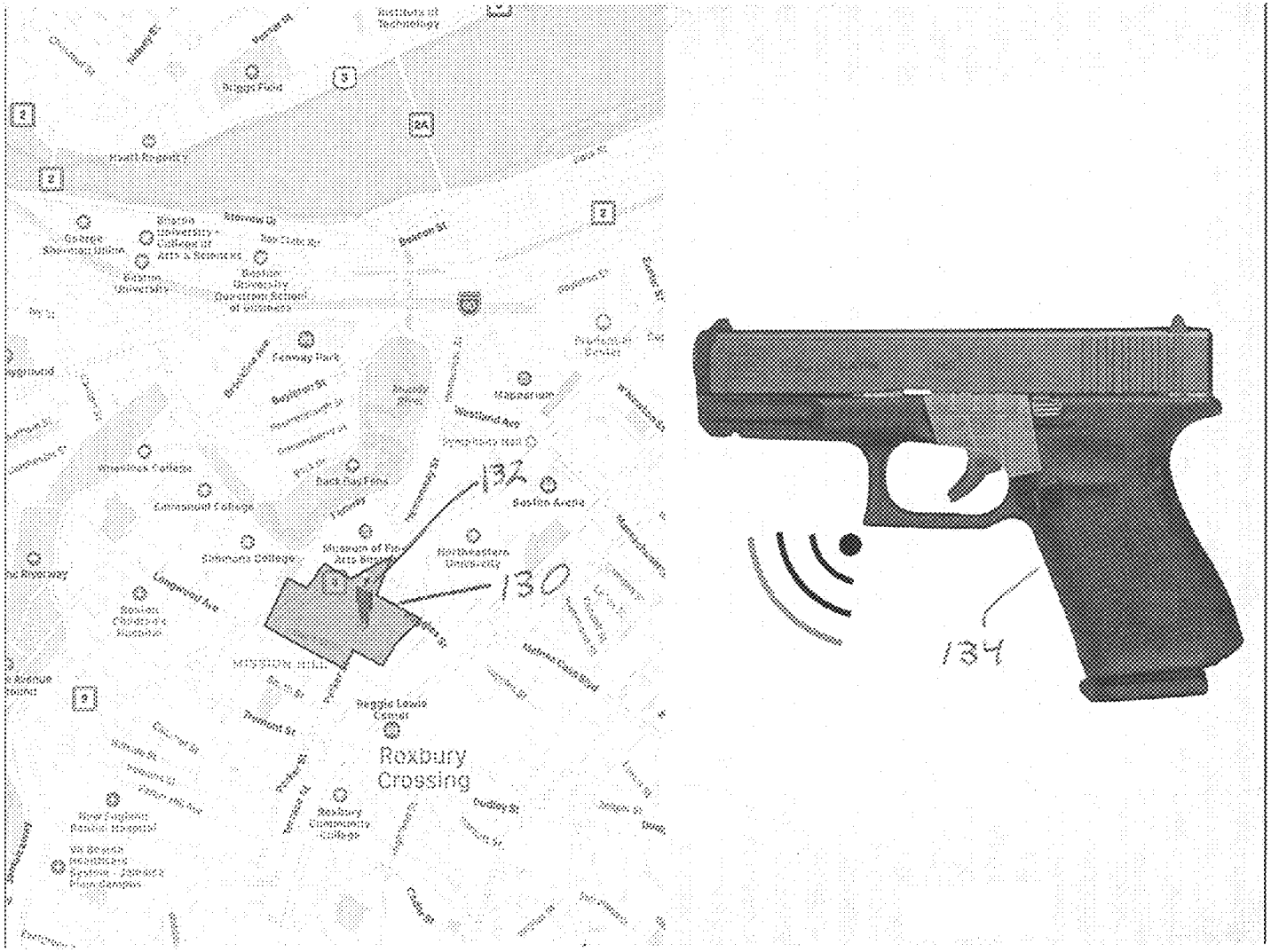
FIG. 4 illustrates a zone of restricted firearms use in accordance with one embodiment.

Referring now to FIG. 4, a zone of restricted firearms use 130 is illustrated in accordance with one embodiment. An individual 132 is also represented in FIG. 4. A close-up view of a firearm 134 possessed by the individual 132 appears on the right side of FIG. 4. According to the illustrated embodiment, the firearm 134 includes the electronic trigger lock system 104 as illustrated and described with reference to FIG. 1. In various embodiments, the zone of restricted firearms use 130 is established such that unauthorized firearms located in the zone 130 are inoperable so long as the firearm is located within the zone.

According to one embodiment, the zone of restricted firearms use 130 is a geo-fenced region with boundaries that are defined by GPS coordinates. This approach allows a very specific area to be pre-defined. For example, the zone of restricted firearms use 130 can be a region (or a portion of a region) surrounding a public venue that is based on topography to eliminate shooting vantage points. In another example, the zone of restricted firearms use 130 is based on the path of a set of streets surrounding a school, i.e., a school zone. Alternatively, GPS can be employed to create a geo-fenced region defined as the zone within a predefined radius of a school. According to this embodiment, the central coordinates of the school property or a school building can be used as the center of a geo-fenced region that has a roughly circular shape. Both topography and building structures can interfere with the receipt of GPS signals and the overall shape of the zone of restricted firearms use 130 in this embodiment.

According to the preceding embodiments, the GPS coordinates of the firearm 134 are determined by the electronic trigger lock system 104 included in the firearm. The location information is communicated over a wireless network to the remote resources to allow the host system to track the location of the firearm 134 and control an operation of the trigger lock 110 based on the location. As a result, the host system included in the remote resources can communicate the signal to render a firearm inoperable when it is located in a pre-defined geo-fenced region.

Because GPS service may not always be available, some embodiments include an RF mode either alone or in combination with the GPS-based system. According to these embodiments, an RF transmitter is used to establish the zone of restricted firearms use 130. In general, the zones 130 established using an RF transmitter have an overall circular shape with a pre-defined radius based on the strength of the transmitter. Both topography and building structures can interfere with the unimpeded transmission of the RF signal and the overall shape of the zone of restricted firearms use 130 in this embodiment.

In operation, a desired zone of restricted firearms use is identified. A broadcasting system is placed at an approximately central location of the zone. A transmitter included in the broadcasting system is operated to continuously transmit a signal that activates the trigger lock 110 of guns within receiving distance of the RF transmitter.

According to various embodiments, any firearm equipped with the electronic trigger lock system can be uniquely identified. The cloud-based resources included in the system can be employed to register a firearm to allow use in the zone of restricted firearms use. For example, embodiments of the systems described herein allow public safety personnel (for example, police officers) to maintain their firearms in a fully operational state within the zone of restricted firearms use 130. Police departments often have lockers in which firearms are stored. According to some embodiments, these "gun lockers" are equipped with RFID readers. The firearms (for example, the handgun 100) include RFID technology. The RFID readers are in communication with the remote cloud-based resources. When a firearm is placed in the RFID enabled gun locker the firearm is identified by the host system as an authorized firearm. Once logged into the system, the firearm is uniquely identified. When such an authorized firearm enters the zone of restricted firearms use 130 the firearm remains operational.

Figure 5:
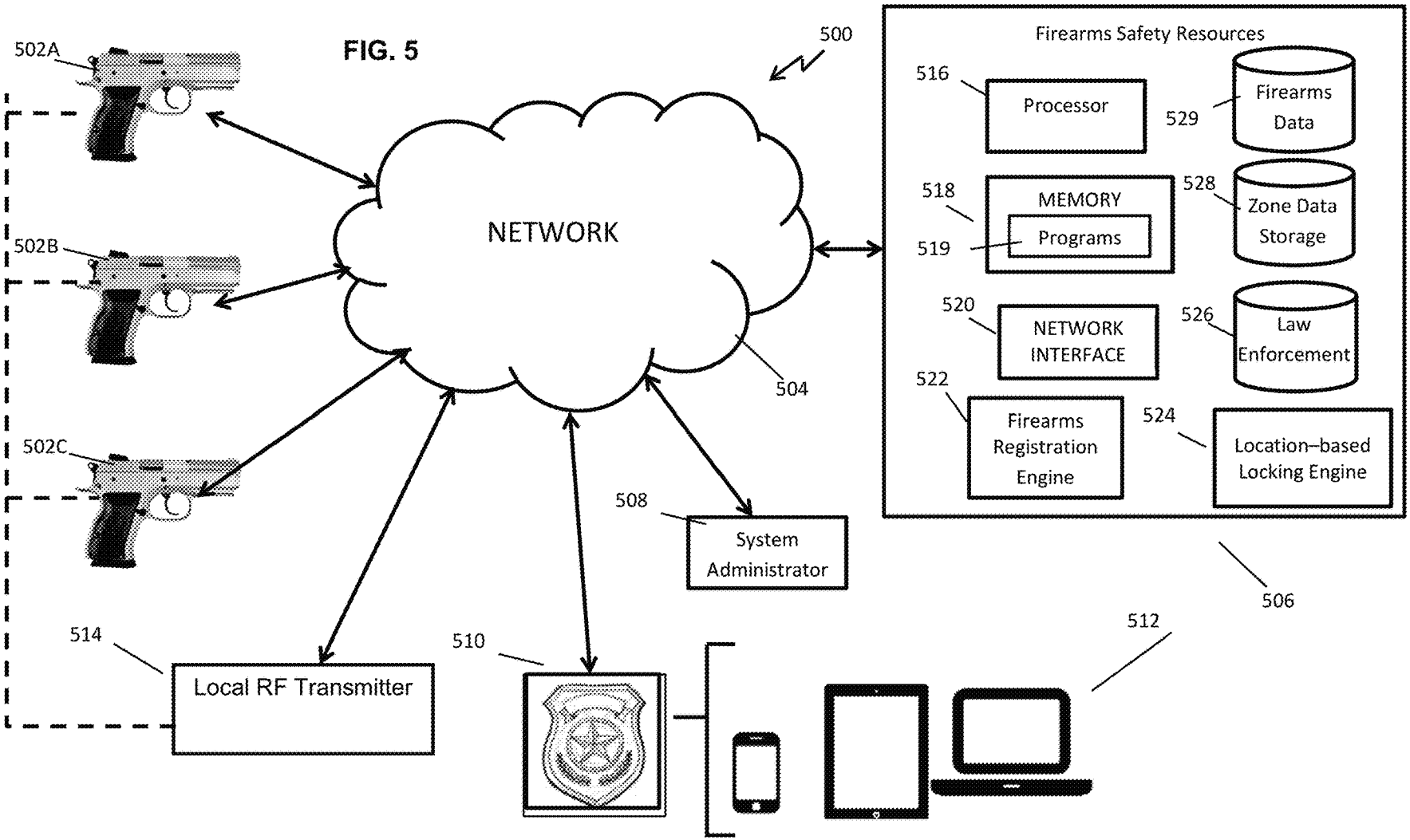
FIG. 5 illustrates a system including a network operating environment for a firearms safety system in accordance with one embodiment.

Referring now to FIG. 5, a network operating environment for a firearms safety system 500 is illustrated in accordance with various embodiments. According to the illustrated embodiment, the system 500 includes a plurality of firearms 502A-C, a network 504, resources 506, a system administrator 508, a public safety authority 510 and a plurality of user devices 512. Optionally, the system 500 can include a local RF communication system 514. In various embodiments, the system 500 is employed to establish and manage zones of restricted firearms use and an inventory of firearms as described in greater detail below. In various embodiments, the system 500 operates to restrict the use of firearms by rendering unauthorized firearms inoperable when located in a zone of restricted firearms use.

In various embodiments, each of the plurality of firearms 502A-502C includes a system such as an electronic system including a trigger lock, for example, the electronic trigger lock system 104. The electronic system that is integral to the firearm can be employed to render a firearm inoperable in the restricted zones.

The system administrator 508 can include an entity and personnel responsible for operation and maintenance of the resources 506. In some embodiments, the system administrator 508 is a service provider that does not have any direct role as a public safety authority. In these, embodiments, the system administrator 508 may be the entity that builds and hosts the resources 506 for the various public safety authorities 510. Thus, the system administrator 508 can include personnel responsible for software design of backend resources and also web or mobile applications offered to the public safety authorities 510 and/or the owners or custodians of the plurality of firearms 502. The system administrator 508 may also be the supplier of the electronic locking systems included in the firearms 508.

The public safety authority 510 can include federal, state or municipal organizations. Further, the public safety authorities can include law enforcement or other government operations depending on the embodiment, for example, education officials. The public safety authority 510 defines zones of restricted firearms use and approves the firearms that are authorized for use in these zones.

In general, the network 504 can include either or both of local-area networks (LANs), wide area networks (WANs), wireless communication, wired communication and may include the Internet. According to a further embodiment, the network 504 provides access to one or more remote devices, servers, application resource management and/or data storage systems, for example, the resources 506. In general, the system 500 provides for communication of the illustrated components with one another and/or with any of the other resources and devices coupled to the network 504. For example, the network 504 can allow communication with the resources 506 for any of the plurality of firearms 502A-C, the system administrator 508 and the public safety authority 510 employing a selected one of the plurality of user devices 512, respectively.

Communication can occur using any of Wi-Fi networks, Bluetooth communication, cellular networks, satellite communication, and peer-to-peer networks available either alone or in combination with one another via the network 504. In one embodiment, the network 504 provides for communication via cellular and/or satellite communication networks, for example, between the plurality of firearms 502 and the resources 506. Depending on the embodiment, the network 504 may be any type and/or form of network known to those of ordinary skill in the art capable of supporting the operations described herein. Thus, other communication protocols and topologies can also be implemented in accordance with various embodiments.

In various embodiments, the resources 506 provide the interface and tools for establishing and managing zones of restricted firearms use, establishing an inventory of firearms equipped with an electronic trigger lock system, setting permissions for each firearm included in the inventory and generating locking signals that are transmitted to disable firearms in restricted zones, as some examples. Further, the resources 506 can be employed to authorize and establish accounts for authorized public safety authorities to employ the resources 506 to establish, manage and set the preceding, respectively.

In the illustrated embodiment, the resources 506 include a processor 516, a memory 518, a network interface 520, a firearms registration engine 522, a location-based locking engine 524, law enforcement data storage 526, zone data storage 528 and firearms data storage 529. The memory 518 includes a plurality of programs 519. Depending on the embodiment, the resources 506 can be hosted on one or more of a variety of computing devices such as a general purpose computer such as a PC, a laptop, a tablet computer, mobile phone, a server or other computing device. According to one embodiment, the resources 506 are distributed across a plurality of computing devices, for example, using a cloud based storage provider.

The network interface 520 is employed for communication, via the network 504, between the resources 506 and other elements connected to the network including the system administrator 508 and the public safety authority 510.

The memory 518 can store the plurality of programs 519 that when executed by the processor 516 operate to receive, store and manage data included in any of the law enforcement data storage 526, the zone data storage 528 and the firearms data storage 529. According to further embodiments, the plurality of programs 519 operate to process information from any one, any combination or all of the preceding data-stores to establish zones of restricted firearms use, register firearms and generate locking signals that render firearms inoperative when they are located within one or more selected zones. In accordance with one embodiment, the location-based locking engine 524 operates in substantially real time.

According to some embodiments, the firearms registration engine 522 operates to allow the registration of each of the plurality of firearms 502 with the system 500. In general, the registered firearms include those firearms equipped with the electronic trigger lock system 104. In a further embodiment, the registrations can include any firearm regardless of whether the firearm is equipped with an electronic trigger lock. In one embodiment, the firearms registration engine 522 operates to prompt a user to provide information to uniquely identify the firearm, and to identify an owner or custodian of the firearm including contact information. The firearms registration engine 522 can also operate to prompt the user (for example, the system administrator 508 or public safety authority 510) to provide an identification of zones of restricted firearms use in which the firearm will remain operational. The preceding information is communicated to the firearms data storage 529.

According to some embodiments, the location-based locking engine 524 receives the GPS location of registered firearms and the GPS coordinates of the zones of restricted firearms use. The location-based locking engine 524 operates to process the information and communicate a signal to the electronic trigger lock system 104 (see FIG. 1) of any of the plurality of firearms 502 that enter a zone where the firearm is not authorized for use. When the signal is received by the firearm 502 the electronic trigger lock operates to disable the firearm by preventing one or more elements included in the firearm from operating. Depending on the embodiment, the element may be physically blocked, physically restrained or physically modified to render the mechanism inoperable. According to one embodiment, the location-based locking engine 524 operates in substantially real time.

According to some embodiments, the law enforcement data storage 526 stores information concerning one or more public safety authorities that employ the system 500. This can include an identification of the public safety authority, authorized users established for the public safety authority and zones of restricted firearms use established by the public safety authority to name a few examples. In various embodiments, the system 500 is employed by multiple public safety authorities. In these embodiments, the public safety authorities may include federal, state or municipal organizations. Further, the public safety authorities can include law enforcement or other government operations depending on the embodiment. According to one embodiment, more than one public safety office can create and manage zones of restricted firearms use in a common geographic area. For example, federal and local law enforcement and/or education officials.

According to some embodiments, the zone data storage 528 stores information that provides the details used to identify, establish and manage zones of restricted firearms use, for example, as illustrated and described with reference to FIG. 7. The zone data storage 528 can record the geographic scope of such zones, dates and times when zones are established, modified and the current operational status of the zones. According to one embodiment, an identification of authorized public safety authorities and associated personnel with access to a zone is maintained in the zone data storage 528. The zone data storage 528 can also include dates and times when uniquely-identified firearms are located within a zone.

According to some embodiments, the firearms data storage 529 stores information concerning each of the plurality of firearms 502 that are registered in the system 500, for example, as illustrated and described with reference to FIG. 8. The firearms data storage 528 can record unique identifying information concerning each of the plurality of firearms 502. The information can also include an identification of the owner of the firearm including contact information such as phone number(s) and address. Where a firearm is owned by a public safety authority 510, the firearms data storage 529 can identify whether the firearm is stored within a locker operated by the public safety authority, or alternatively, in possession of an authorized individual such as a police officer or a public school teacher or security guard. Each registered firearm can also be associated with one or more zones of restricted firearms use in which the firearm will remain operational. The firearms data storage 529 can maintain information that identifies these zones in association with the selected firearm.

The firearms data storage can also store location information concerning registered firearms. This information can include the dates and times when the uniquely-identified firearm is located within a particular zone, enters the zone and departs from the zone. The preceding information can be stored regardless of whether the firearm was authorized for use in the zone such that it remained operational, or alternatively, rendered inoperative because it was not authorized for use in the zone.

Depending on the embodiment, each of the law enforcement data storage 526, the zone data storage 528 and the firearms data storage 529, respectively, can include any of a relational database, object-oriented database, unstructured database, or other database. Further, the law enforcement data storage 526, the zone data storage 528 and the firearms data storage 529 can be included in any aspect of a memory system, such as in RAM, ROM or disc, and may also be separately stored on one or more dedicated data servers included in the resources 506. In addition, the data storage can be organized in a manner different than illustrated in FIG. 5. The various data storage requirements can be modified to combine, change or eliminate all or a portion of the law enforcement data storage 526, the zone data storage 528 and the firearms data storage 529, respectively, depending on the embodiment. While the law enforcement data storage 526, the zone data storage 528 and the firearms data storage 529 are identified in FIG. 5, those of ordinary skill in the art will recognize based on the disclosure provided herein that the resources 526 can include storage for other types of data and file-types depending on the embodiment.

The components included in the resources 506 can be coupled by one or more communication buses or signal lines. The communication buses can be used for the communication of instructions/commands and data between the illustrated components and between the illustrated components and other components included in the resources 506 depending on the embodiment.

The plurality of user devices 512 can include any type of computing device suitable for communicating with the resources 506 via the network 504. Accordingly, the plurality of user devices 512 of can include one or more of a variety of computing devices such as a general purpose computer, for example, a PC, a laptop, a tablet computer, a hand-held computer, a personal digital assistant, a mobile telephone, a camera, a smart phone or a laptop computer.

In the illustrated embodiment, the local RF communication system 514 can be included to allow a zone of restricted firearms use to be implemented in an area where GPS signal reception is unreliable. A broadcasting system is placed at an approximately central location of the zone. A transmitter included in the broadcasting system is operated to transmit a signal that activates the electronic apparatus (for example, the trigger lock 110 of FIG. 1) included in firearms within receiving distance of the RF transmitter unless the firearm is authorized for use in the zone. The electronic apparatus renders the unauthorized firearms inoperative.

Figure 6:
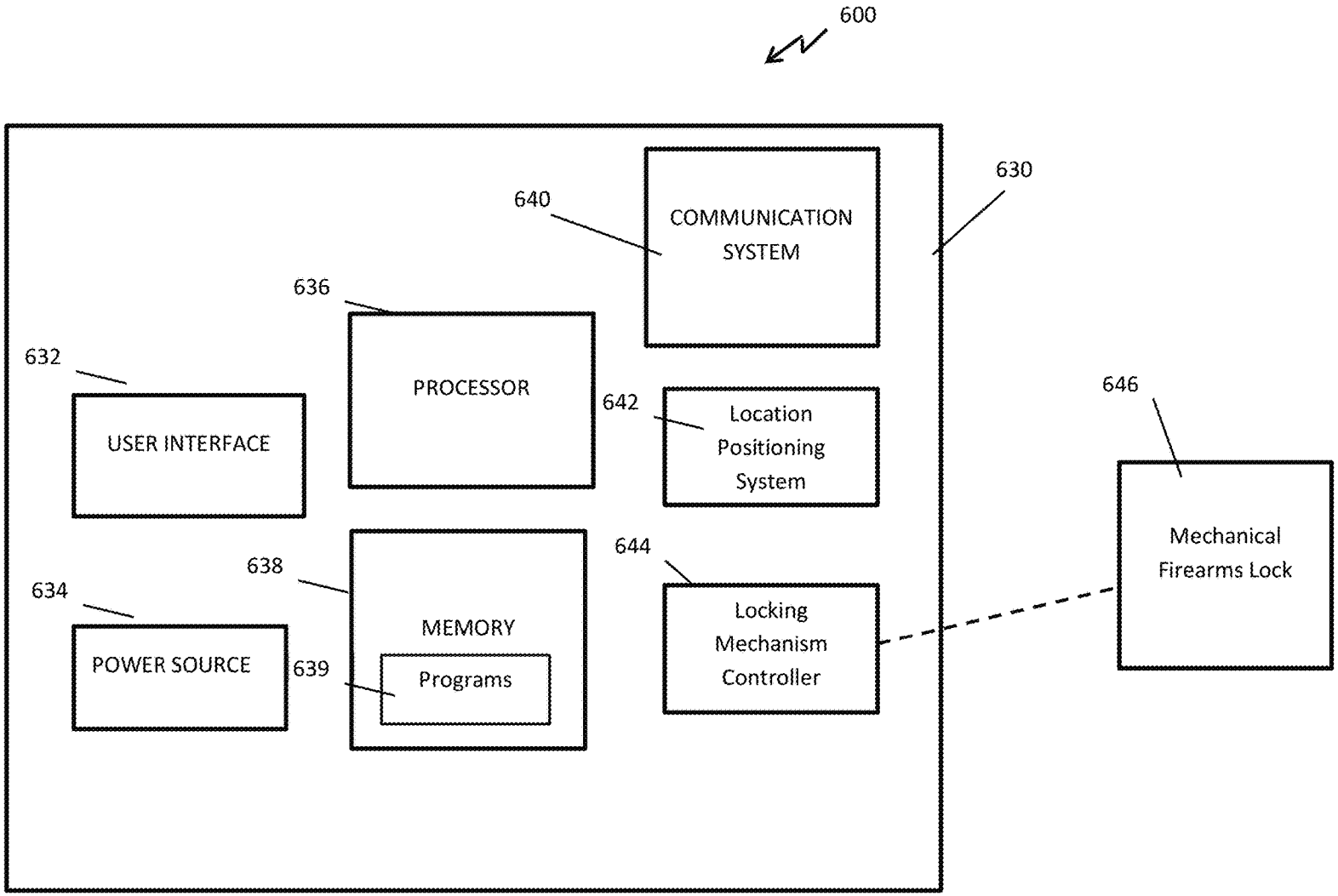
FIG. 6 illustrates a block diagram of an electronic trigger lock system in accordance with one embodiment.

Referring now to FIG. 6, a system 600 including an electronic apparatus 630 and a mechanical firearms lock 646 is illustrated in accordance with various embodiments. According to some embodiments, the system 600 includes the electronic apparatus and associated elements that are located in a firearm, for example, the firearm 100 of FIG. 1 or any of the plurality of firearms 502 illustrated in FIG. 5. According to the illustrated embodiment, the electronic apparatus 630 includes a user interface 632, a power source 634, a processor 636, a memory 638, a communication system 640, a location positioning system 642 and a locking mechanism controller 644. In various embodiments, the electronic apparatus 630 is connected to the mechanical firearms lock 646. In general, the electronic apparatus 630 operates by receiving a signal that prompts the locking mechanism controller 644 to operate the mechanical firearms lock 646. The mechanical firearms lock 646 renders the firearm inoperable by physically blocking, restraining or modifying the firing mechanism.

In general, the user interface 632 communicates information concerning the operating status of the electronic apparatus 630 to the operator of the firearm. For example, the user interface can provide a charge indication to the operator to make them aware of the charge-status of a battery power source included in the electronic apparatus 630. Further, the user interface 632 can allow the operator a limited ability to control some operations of the electronic apparatus 630 provided that they do not allow the operator to override the trigger locking functionality of the system. For example, the user interface can 632 include an input that the operator employs to activate wireless communication. Depending on the embodiment, the user interface can include one or a combination of LEDs, switches, knobs, dials, buttons, sliders or a display as some examples. According to some embodiments, the user interface 632 is provided for display in the user's portable electronic device such as a phone or tablet. For example, in one embodiment, the user has the ability to remotely lock the firearm with an electronic trigger lock system in the firearm via an application that includes a user interface displayed on their smartphone or tablet.

According to some embodiments, the power source 634 includes one or more batteries or other electrical energy storage devices. In one embodiment, the power source 634 includes a rechargeable battery such as a lithium ion battery. In further embodiments, the power source 634 includes a power generation source, for example, as described with reference to the firearm 100 and electronic trigger lock system 104 of FIG. 1. In these embodiments, the action of the slide 103 operates one or more elements included in the electronic apparatus 630 to generate electrical power to recharge an energy storage device included in the power source 634. In any of the preceding approaches, the electronic apparatus 630 includes one or more power circuits that connect components included in the apparatus 630 to the power source 634.

Depending on the embodiment, the processor 636 can be a standalone element, for example, a microprocessor. In another embodiment, the processor 636 is included in microcontroller. In one embodiment, the memory 638 is included in the processor 636. In another embodiment, the memory 638 includes memory internal to the processor 636 and memory external to the processor. Depending on the embodiment, the memory 638 can include RAM, ROM, EEPROM and/or FLASH memory. In various embodiments, the memory 638 is configured to store software instructions 639. Depending on the embodiment, the software instructions 639 can be implemented as individual software programs or modules, or combined with one or another in various configurations. Also depending on the embodiment, various functions of the electronic apparatus 630 can be implemented in hardware and/or in software, including in one or more signal processing and/or application specific integrated circuits.

Depending on the embodiment, the communication system 640 can include any of Wi-Fi networks, Bluetooth™ communication, cellular networks, satellite communication, and peer-to-peer networks available either alone or in combination with one another. Other communication protocols and topologies can also be implemented in accordance with various embodiments.

In various embodiments, the location positioning system 642 can employ cellular triangulation, RFID, GPS or any of the preceding alone, in combination with one another or in combination with other location positioning technology. For example, in further embodiments, the location positioning system 642 includes inertial sensing systems such as accelerometers and/or gyroscopes employed in an inertial navigation system. In some embodiments, the location positioning system 642 is employed to identify the location of the firearm 100, 502 for communication to the resources 506 illustrated in FIG. 5.

According to some embodiments, the location-based locking engine 524 processes the information received from the electronic apparatus 630 to determine whether the firearm in which the system 600 is installed is located in a zone of restricted firearms use, and if so, whether it is authorized for use in the zone. A locking signal is communicated from the resources 506 to render the firearm inoperable when the location-based locking engine 524 determines the firearm in which the system 600 is installed is located in a zone of restricted firearms in which it is not authorized for use.

Depending on the embodiment, the locking mechanism controller 644 includes control logic and an electrically operated element employed to operate the mechanical firearms lock 646. The mechanical firearms lock 646 renders the firearm inoperable by physically blocking, restraining or modifying the firing mechanism. The locking mechanism controller 646 can include any of a solenoid-operated linear actuator, a rotary actuator or a different operating element capable of operating in at least two states, for example, by changing from a first state to a second state based on receipt of an electrical signal that includes either or both of a logic signal or a power signal. The two states can include a first state or "live" position in which the handgun is operational in a conventional fashion and a second "locked" state in which the firearm is rendered inoperable. For example, as illustrated and described with reference to the trigger lock 110 to FIG. 2. In general, the mechanical firearms lock 646 includes mechanical hardware coupled to the locking mechanism controller that is employed to interact with the trigger 102 and/or other element of the firing mechanism to render the firing mechanism of the firearm inoperable when in the second state. The mechanical connection between the mechanical firearms lock 646 and the trigger and/or other element of the firing mechanism can vary depending on the embodiment. According to some embodiments, the mechanical firearms lock 646 includes a compliant mechanism.

Figure 7:
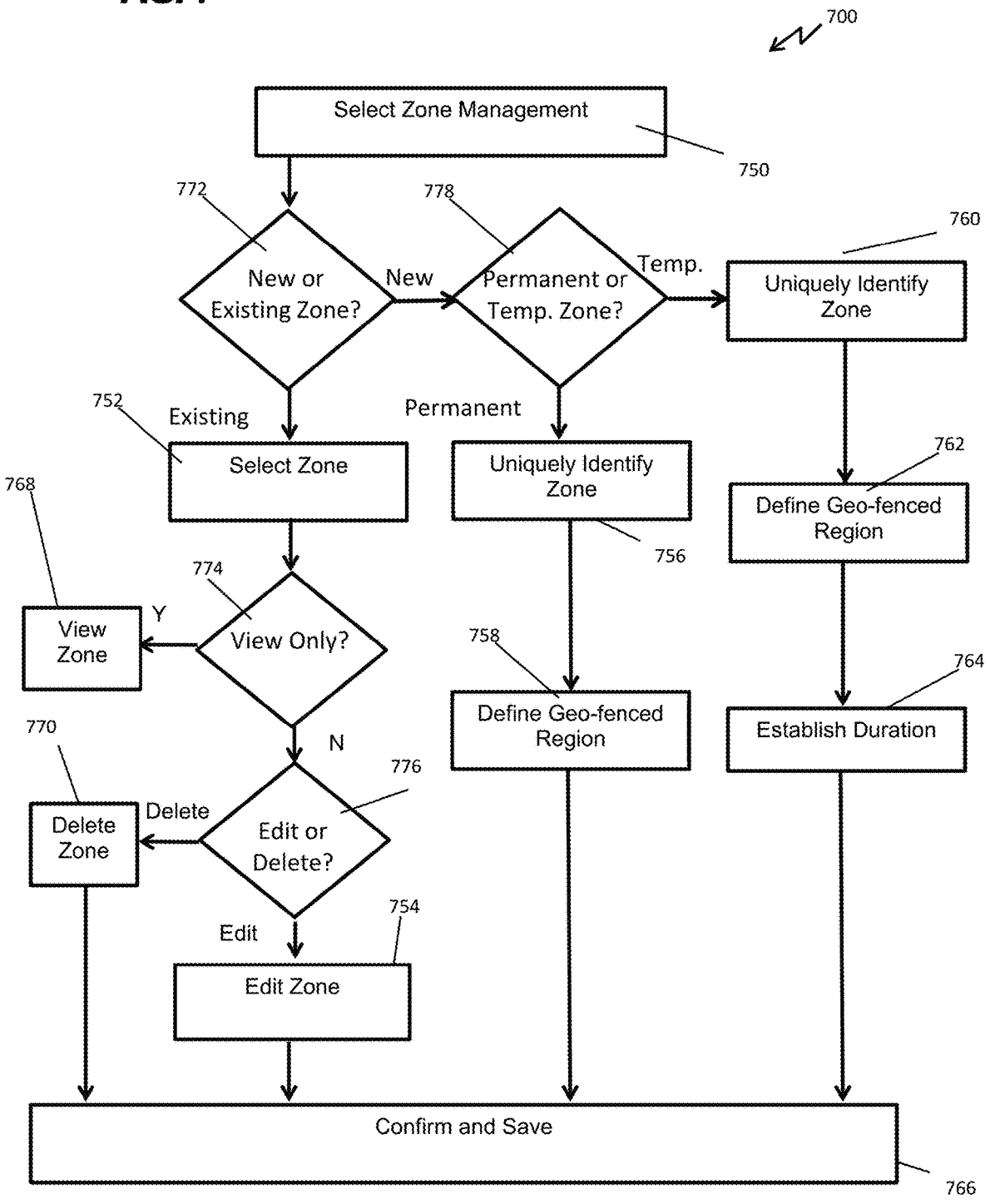
FIG. 7 illustrates a flow diagram of a process for managing zones of restricted firearms use in accordance with one embodiment.

Referring now to FIG. 7, a process for managing zones of restricted firearms use is illustrated in accordance with one embodiment. In general, the process 700 is employed by a user (for example, a member of the public safety authority 510 or the system administrator 508) to establish and manage zones of restricted firearms use. The process 700 can be employed to establish and manage permanent zones or temporary zones of restricted firearms use, respectively. Further, the process 700 allows a user to create, define, modify or simply view information concerning the zones.

The process 700 includes a series of acts including actions and decision points. The actions include an act of selecting the zone management application 750, an act of selecting an existing zone 752, an act of editing a zone 754, an first act of uniquely identifying a zone 756, a first act of defining a geo-fenced region 758, a second act of uniquely identifying a zone 760, a second act of defining a geo-fenced region 762, an act of establishing a duration of a temporary zone 764, an act of confirming and saving a change to the zones 766, an act of viewing a zone 768 and an act of deleting a zone 770. The decision points include an act of determining whether an existing zone will be accessed or a new zone created 772, an act of determining whether a selected zone will be viewed or changed 774, an act of determining whether a selected zone will be edited or removed 776, and an act of determining whether a newly created zone will be a permanent zone or a temporary zone 778.

According to various embodiments, the system 500 and resources 506 can be employed to allow the system administrator 508 and the public safety authority 510 to view or change one or more zones via the process 700, for example, using a web application. The process 700 begins at the act of selecting the zone management application 750 available via the resources 506. For example, the application may provide other functionality that the user can access instead of zone management. The process moves to the act of determining whether an existing zone will be accessed or a new zone created 772. Here, the user navigates the application to proceed to the desired function. If the user selects "existing zone" at the act 772, the process 700 moves to selecting the existing zone 752 where they provide and/or select the unique identifier associated with a zone they wish to view, edit or delete.

When the zone is selected, the process 700 moves to the act of determining whether the selected zone will only be viewed or changed 774. If the user decides to view the zone, the process 700 moves to the act of viewing the selected zone 768. In one embodiment, the application renders information for display to the user concerning the selected zone. The information can include identification information such as names and property address(es) included in the zone, maps or images that illustrate the geo-fenced region defined for the zone and an identification of the controlling public safety authority for the zone as some examples.

Alternatively, if the user elects to make a change to a zone, the process 700 moves from the act 774 to the act of determining whether the selected zone will be edited or removed 776. If the user selects "remove" or "delete", the process moves from the act 776 to the act of deleting the zone 770. The user is then provided an opportunity to confirm and save the removal of the zone at the act 766. According to one embodiment, the removal eliminates a zone of restricted firearms use such that the firearms previously rendered inoperative in the zone will no longer be disabled when in that location. The preceding can result for example with a change in property use. A demolition of a school provides one such example.

If at the act of determining whether the selected zone will be edited or removed 776, the user elects to edit, the process 700 moves to the act of editing the zone 754. Here, the application can provide the authorized user with access to information concerning the selected zone. Depending on the embodiment, the user can change the geographic size and/or boundaries of the zone or revise identification information concerning the zone as two examples. According to one embodiment, the user can review a list of firearms authorized for use in the zone and remove any firearms that no longer authorized, for example, where the ownership of the firearm has changed. Once the edits are complete, the process moves to the act of confirming and saving the information 766. Here, the user is provided an opportunity to review the edits to the zone before the information is saved.

If the user selects "new zone" at the act 772, the process 700 moves to the act 778 where the user elects to either create permanent zone or a temporary zone. As used here, the term "permanent" refers to the fact that the zone is established for an indefinite length of time. As will be apparent to one of ordinary skill in the art in view of the disclosure provided herein, a permanent zone can be modified or deleted if the responsible authority finds that it is no longer needed. In contrast, a temporary zone has a fixed duration that is established when the zone is first created. Temporary zones can also be modified or deleted in advance of the originally-scheduled end date.

With a permanent zone selected at the act 778, the process 700 moves to the first act of uniquely identifying the zone. Here, the user provides identification information, for example, name, address that distinguishes the new zone from any other zones that already exist in the system. With the unique identifying information provided, the process moves to the first act of defining a geo-fenced region 758. Here, the user provides the GPS coordinates of the zone. This information can be provided in different ways depending on the embodiment. In one approach, the user identifies a GPS coordinate that identifies a centrally located position in the zone along with a desired radius for the zone. In an alternate approach, the user identifies the GPS coordinates that define an outer edge of the zone. For example, the user can provide a first GPS coordinate that corresponds to a first street corner at the edge of the zone, a second GPS coordinate that corresponds to a second street corner, etc. In this example, the outer boundaries that define the zone are the streets that run between the GPS coordinates provided by the user.

Once the geo-fenced region is defined by the user at the act 758, the process moves to the act of confirming and saving the information 766. Here, the user is provided an opportunity to review and edit the identification and boundaries for the zone before the information is saved.

With a temporary zone selected at the act 778, the process 700 moves to the second act of uniquely identifying the zone 760. Here, the user provides identification information, for example, name, address that distinguishes the temporary zone from any other zones that already exist in the system. With the unique identifying information provided, the process moves to the second act of defining a geo-fenced region 762. Here too, the user provides the GPS coordinates of the zone. This information can be provided in different ways depending on the embodiment. In one approach, the user identifies a GPS coordinate that identifies a centrally located position in the zone along with a desired radius for the zone. In an alternate approach, the user identifies the GPS coordinates that define an outer edge of the zone. For example, the user can provide a first GPS coordinate that corresponds to a first street corner at the edge of the zone, a second GPS coordinate that corresponds to a second street corner, etc. In this example, the outer boundaries that define the zone are the streets that run between the GPS coordinates.

Once the geo-fenced region is defined by the user at the act 762, the process moves to the act of establishing a duration of the temporary zone 764. Here, the user identifies the dates and times during which the temporary zone will be active. For example, an ordinary venue that becomes a host for a concert or event expected to draw a crowd provides one example where a temporary zone can be established for the duration of the event. In this example, the temporary zone may be set-up for two or three days. With the geo-fenced region and duration of the temporary zone established by the user, the process moves to the act of confirming and saving the information 766. Here, the user is provided an opportunity to review and edit the identification, boundaries and duration for the zone before the information is saved.

Figure 8:
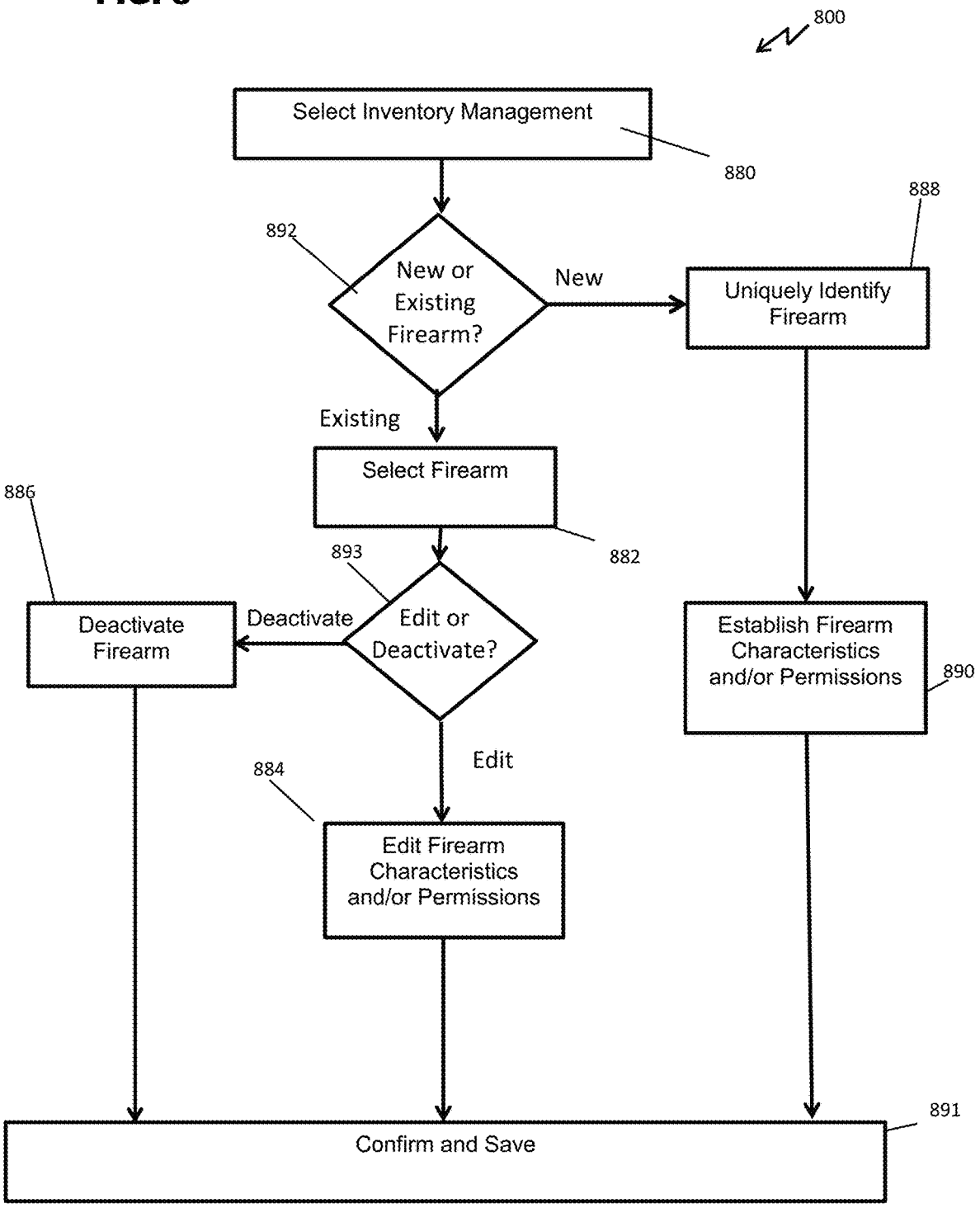
FIG. 8 illustrates a flow diagram of a process for managing a firearms inventory in accordance with one embodiment.

Referring now to FIG. 8, a process for managing an inventory of firearms is illustrated in accordance with one embodiment. In general, the process 800 is employed by a user (for example, a member of the public safety authority 510 or the system administrator 508) to add or deactivate firearms and to set the permissions for the use of each firearm. The process 800 includes a series of acts including actions and decision points. The actions include an act of selecting the inventory management application 880, an act of selecting an existing firearm 882, an act of editing characteristics and/or permissions for the firearm 884, an act of deactivating a firearm 886, an act of uniquely identifying a firearm 888, an act of establishing characteristics and/or permissions for the firearm 890 and an act of confirming and saving a change to the inventory of firearms 891. The decision points include an act of determining whether an existing firearm will be accessed or a new firearm added 892 and an act of determining whether a selected firearm will be edited or deactivated 893.

According to various embodiments, the system 500 and resources 506 can be employed to allow the system administrator 508 and the public safety authority 510 to add, remove, view or change one or more firearms in the system inventory via the process 800, for example, using the web application that also allows for zone management. The process 800 begins at the act of selecting the inventory management application 880 available via the resources 506. The process moves to the act of determining whether records concerning an existing firearm will be accessed or a new firearm added to the inventory 892. Here, the user navigates the application to proceed to the desired function. If the user selects "existing firearm" at the act 892, the process 800 moves to selecting the firearm 882 where they provide and/or select the unique identifier associated with a firearm they wish to view, edit or deactivate.

When the firearm is selected, the process 800 moves to the act of determining whether the selected firearm will be viewed or deactivated 886. If the user decides to deactivate the firearm, the process 800 moves to the act of deactivating the selected firearm 886. A firearm will be deactivated when, for example, it is no longer eligible for operation in a zone of restricted firearms use. The preceding may be a result of a change in ownership or custodianship of the firearm or a change or deletion of a zone in which the firearm was authorized for operation. With the firearm identified by the user, the process moves to the act of confirming and saving the information 891. Here, the user is provided an opportunity to review the change before the record is either deleted or the firearm permission removed.

If the user decides to edit the firearm at the act 893, the process 800 moves to the act of editing the characteristics and/or permissions of the firearm 884. Here, the user is provided with an ability to add or remove the zones of restricted firearms use for which the firearm is authorized for use. Other permissions associated with the firearm can also be updated, for example, the individuals authorized to carry the firearm. The user can also update identification information, for example, the firearms identification and owner identification as two examples. With the edits made by the user, the process moves to the act of confirming and saving the changes 891. Here, the user is provided an opportunity to review the edits before the record is updated.

If the user selects "new" at the act of selecting a new or existing firearm 892, the process 800 moves to the act of uniquely identifying a firearm 888. Here, the user provides identification information that uniquely identifies the firearm that is being added to the inventory. In some embodiments, the serial number of the firearm is provided at the act 888. However, other information can be provided alone or in addition to the serial number. In general, the identifying information is provided in alpha numeric form. The information or combination of information is used to uniquely identify the firearm.

During the setup for a new firearm, the user also provides the characteristics and/or permissions for the new firearm at the act 890. Here, the user is provided with an ability to identify any zones of restricted firearms use in which the firearm is authorized for use. Other permissions associated with the firearm can also be provided, for example, the individuals authorized to carry the firearm. The user can also include temporal restrictions on the permissions, for example, by establishing authorized use for specific dates, times days of the week, etc. Characteristics can include the make and model of the firearm, for example. With the characteristics and permissions established, the process moves to the act of confirming and saving the new firearm 891. Here, the user is provided an opportunity to review the identification, characteristics and permissions before the record is updated.

Figure 9:
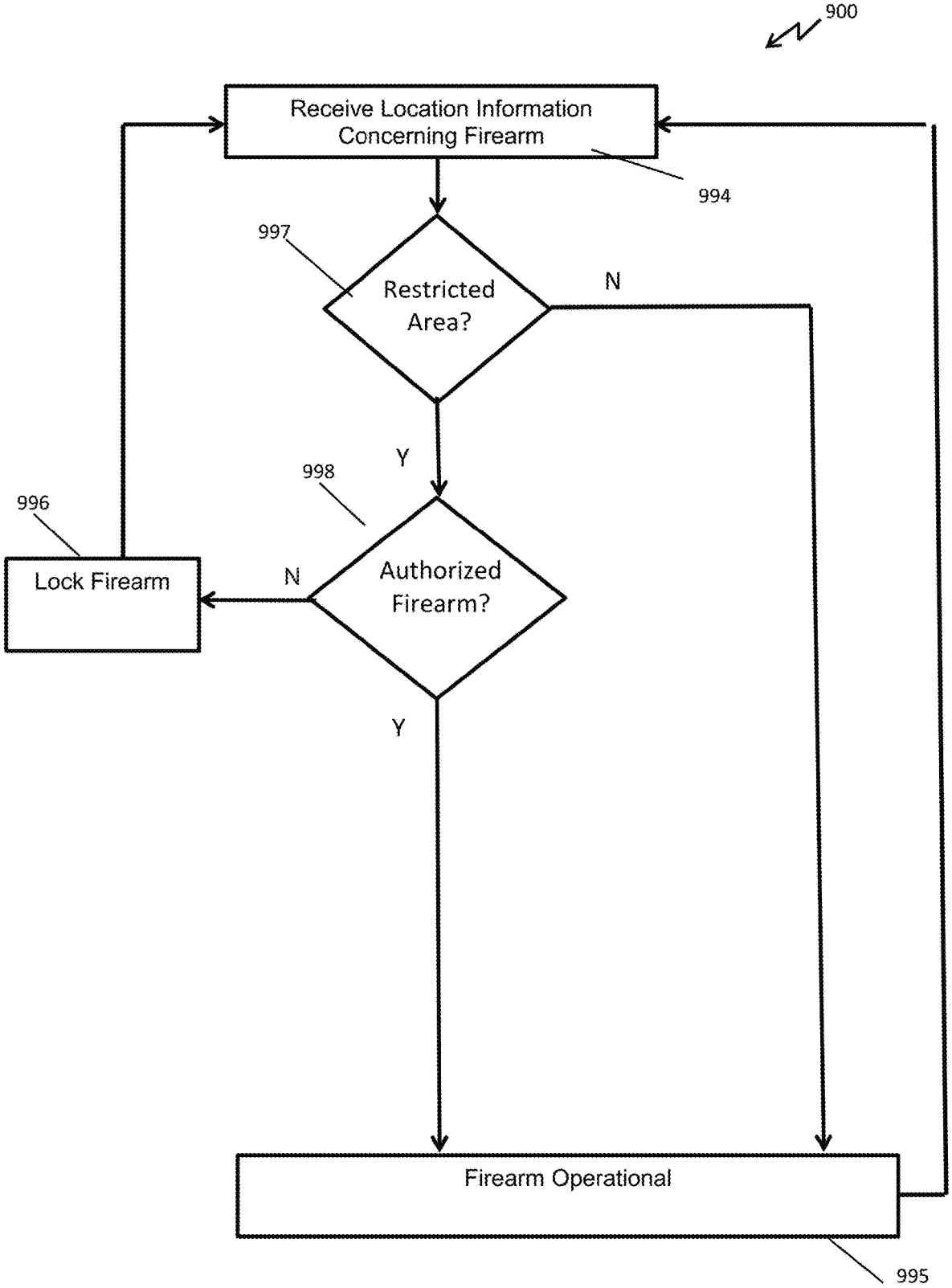
FIG. 9 illustrates a flow diagram of a process for preventing a firearm from being used in a restricted area in accordance with one embodiment.

FIG. 9 illustrates a flow diagram of a process 900 for preventing a firearm from being operated in a zone of restarted firearms use in accordance with one embodiment. In general, the process 900 is a result of a monitoring of a location of the firearm and interaction with an electronic apparatus included in the firearm, for example, the electronic trigger lock 104. According to one embodiment, the process 900 is a result of an operation of the system 500 illustrated in FIG. 5 in combination with the system 600 illustrated in FIG. 6. In a further embodiment, the process 900 is executed in part using the location-based locking engine 524, the locking mechanism controller 644 and the mechanical firearms lock 646.

The process 900 includes a series of acts including actions and decision points. The actions include an act of receiving location information concerning a firearm 994, an act of maintaining a firearm in an operational state 995 and an act of locking a firearm 996. The decision points include an act of determining whether a firearm is located in a zone of restricted firearms use 997 and an act of determining whether a firearm located in a zone of restricted firearms use is authorized for operation within the zone 998.

The process 900 begins with the act of receiving location information concerning a firearm 994. This act can be implemented with a communication of the GPS coordinates from the firearm to the system resources, for example, the resources 506. For example, depending on the embodiment, the GPS information is provided by the electronic trigger lock 104 or the electronic apparatus 630. According to various embodiments, the communication of the GPS information occurs on a substantially real time basis. The process moves to the act of determining whether the firearm is located in a zone of restricted firearms use 997. According to one embodiment, this act is implemented in resources remote from the firearm, for example, the resources 506. In this embodiment, the location-based locking engine 524 or another element included in the system 500 evaluates the current GPS coordinates received from the firearm against the geo-fenced zones of restricted firearms use maintained by the system.

If the GPS coordinates are not within a zone of restricted firearms use, the process 900 moves to the act of maintaining the firearm in an operational state 995. According to various embodiments, the "live" or the fully operational state of the firearm is the default operating state. In these embodiments, no affirmative action is required as a part of the process 900. Thereafter, the process 900 returns to the start of the process 900 and the act 994 to monitor the location of the firearm on a substantially continuous basis.

If at the act 997, the firearm is located within a zone of restricted firearms use, the process 900 moves to the act of determining whether the firearm is authorized for operation within the zone 998. According to one embodiment, the system resources 506 are employed to process the location information in combination with information concerning the locations of the geo-fenced regions at the act 998. According to one embodiment, the preceding is performed by the location-based locking engine 524 included in the system resources 506. If the firearm is located in a zone of restricted firearms use where it is authorized for use, the process 900 moves to the act of maintaining the firearm in an operational state 995.

If the firearm is located in a zone of restricted firearms use where it is not authorized for use, the process 900 moves to the act of locking the firearm 996. According to one embodiment, the location-based locking engine 524 generates a locking signal that is communicated from the system resources 506 to the firearm. The electronic apparatus in the firearm receives the signal and operates to render the firearm inoperative. The process 900 then returns to the act of receiving location information concerning the firearm 994. In some embodiments, the preceding is performed on a substantially continuous basis such that the process 900 operates to return the firearm to a fully operational status when the firearm is moved outside the zone of restricted firearms use.

According to various embodiments, the approaches described herein include the use of a compliant mechanism included in the firearm. For example, in one embodiment, the electronic trigger lock system 104 includes a compliant mechanism. As another example, the mechanical firearms lock 646 of the system 600 includes a compliant mechanism. In various embodiments, the compliant mechanism is characterized by the use of one or more flexible members that store energy. In further embodiments, the energy storage characteristics of the flexible members are designed with specific force-deflection properties, for example, properties that cause the mechanism to bias to a desired position. According to some embodiment, the compliant mechanism is integrated into the firing mechanism of a firearm where it can be employed to maintain a firearm in a fully operational state when in a first state and also render the firing mechanism inoperable when in a second state. As used herein, the term "inoperable" means that the firearm cannot be operated to fire ammunition. One of ordinary skill in the art in view of the disclosure provided herein will recognize that portions of a firing mechanism can be operational or move when the trigger of the firearm is pulled even though the firearm is rendered inoperable. Further, a firearm that is rendered inoperable may also be capable of loading and/or ejecting ammunition.

Applicants have recognized advantages provided by the inclusion of a compliant mechanism in a trigger locking device. These advantages can include increased reliability because compliant mechanisms reduce parts counts, greater precision in motion because compliant mechanism reduce the need to provide "slack" in the mechanism, reduced requirements for lubrication because the locking mechanism has fewer movable joints than other forms of locking mechanisms, reduced size and weight of the locking mechanism, reduced travel required of operating elements required to render the firearm inoperable and reduced manufacturing complexity.

Figure 10A:
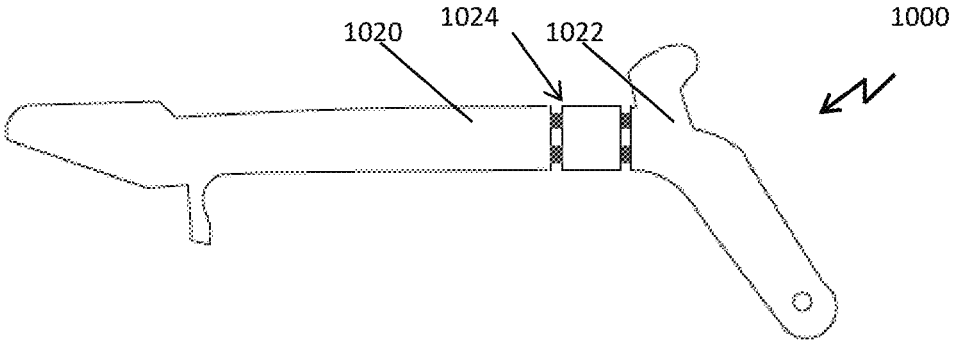
FIGS. 10A-10C illustrate a locking mechanism in a first state in accordance with one embodiment.

Referring now to FIG. 10A, a locking mechanism 1000 is illustrated in accordance with one embodiment. The locking mechanism 1000 includes a rear trigger bar 1020, a front trigger bar 1022 and a compliant mechanism 1024. In the illustrated embodiment, the compliant mechanism 1024 connects the rear trigger bar 1020 to the front trigger bar 1022. In general, the locking mechanism 1000 is included in an otherwise conventional firing mechanism used to transfer the displacement caused when a trigger is pulled to cause a firing pin to operate. In general, a firearms operating mechanism includes mechanical components (or "linkage") that couples the trigger to a firing pin. According to the illustrated embodiment, in an overall firearms operating mechanism, front trigger bar 1022 is connected most closely to the trigger of the firearm while the rear trigger bar 1020 is closer to the firing pin in the linkage.

Figure 10B:
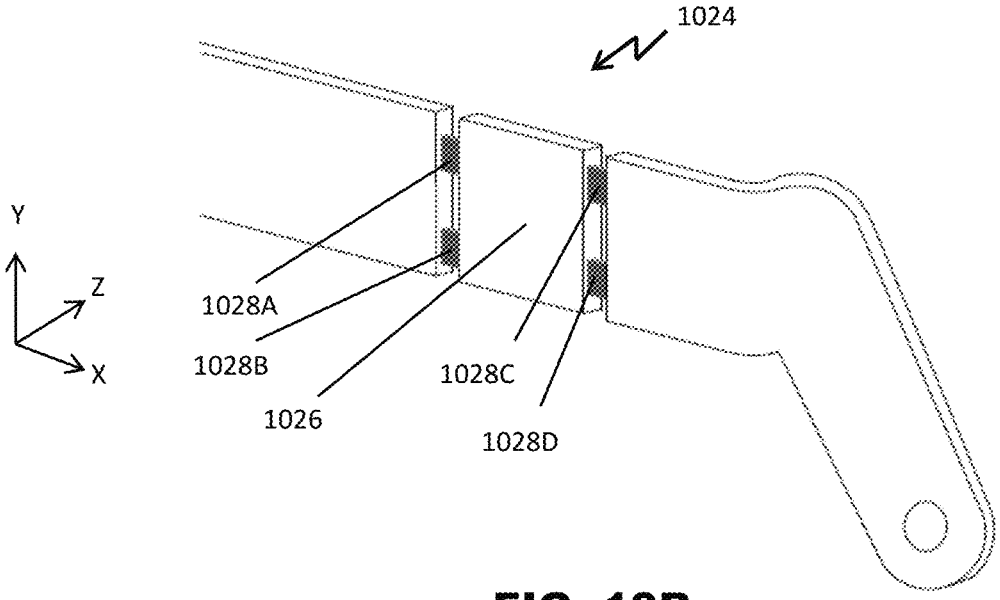

FIG. 10B illustrates a close-up view of the compliant mechanism 1024. According to the illustrated embodiment, the compliant mechanism 1024 includes a rigid member 1026 and a plurality of flexible elements 1028A-D. The plurality of flexible elements 1028 include a first flexible element 1028A, a second flexible element 1028B, a third flexible element 1028C and a fourth flexible element 1028D.

Figure 10C:
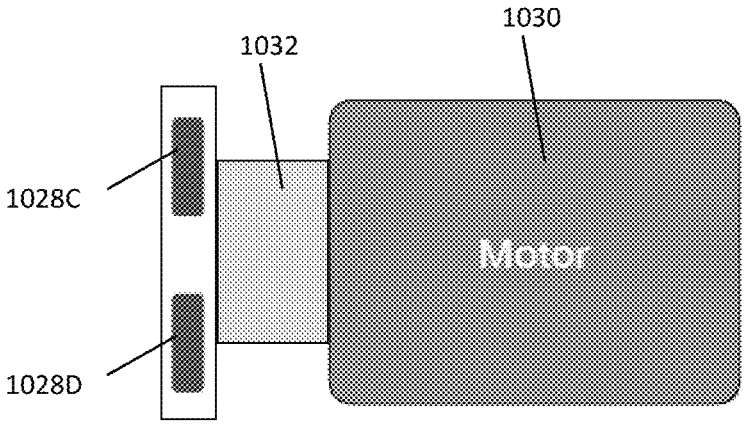

FIG. 10C is a cross-sectional view in plane located at the third flexible member 1028C and the fourth flexible member 1028D made perpendicular to the plane of the trigger bar and facing in the direction of the rigid member 1026. FIG. 10C illustrates an electromechanical operator 1030 for the compliant mechanism 1024. A connector 1032 connects the electromechanical operator 1030 to the compliant mechanism 1024 via a mechanical attachment.

Depending on the embodiment, the rigid member 1026 can be manufactured from the same material as the trigger bar or a different material as the trigger bar. Thus, the rigid member can be manufactured from metal, metal alloys or plastic depending on the embodiment. According to one embodiment, the rigid member 1026 and the plurality of flexible members 1028A-C are both manufactured from the same material as the remainder of the firearms operating mechanism. According to one embodiment, the rigid member 1026 and the plurality of flexible members 1028A-C are manufactured from steel. Alternate materials of manufacture include: fiber glass; carbon fiber, titanium, tungsten, inconel, chromium and aluminum While the electromechanical operator 1030 is identified as a motor in FIG. 10C, other forms of actuators can be employed in various embodiments. Thus, the electromechanical operator 1030 can include any of a linear actuator, a rotary actuator, a solenoid or a MEMS device, as some examples. Accordingly, the connector 1032 can include a coupling, a gear, shaft or plunger and associated fastening hardware, if necessary, as some examples.

Figure 11A:
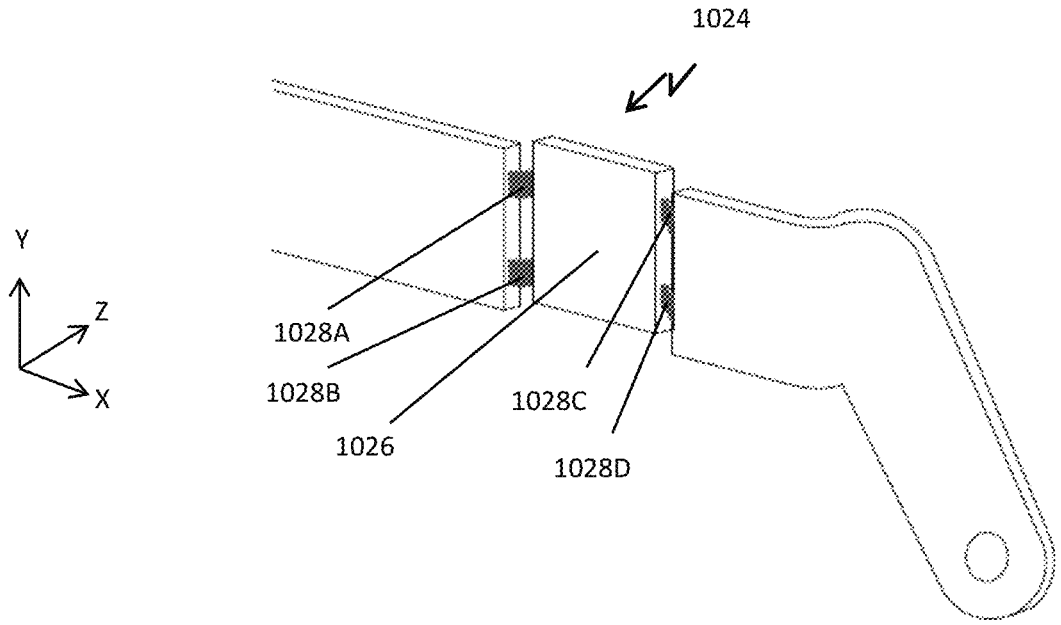
FIGS. 11A-11B illustrate the locking mechanism of FIGS. 10A-10C in a second state in accordance with one embodiment.
Figure 11B:
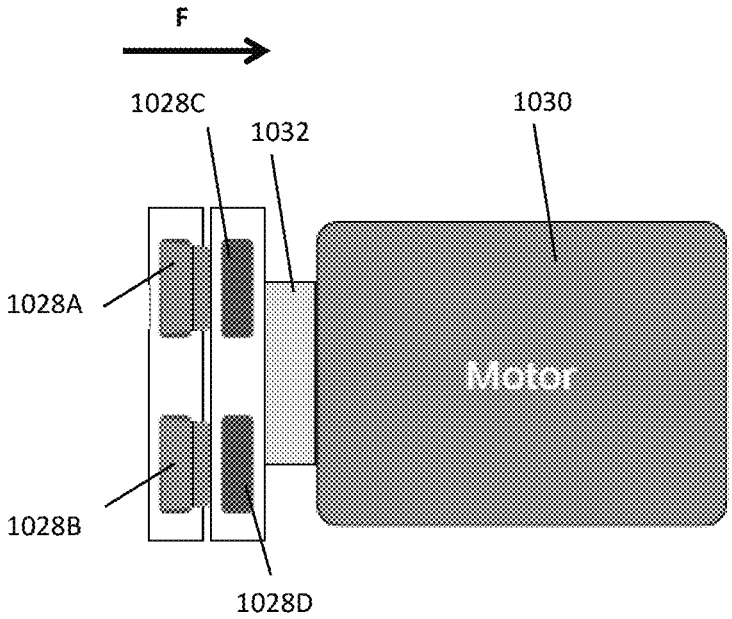

In general, the locking mechanism 1000 is operational in two states, a first state in which the firearm in which it is included is operational and a second state in which the firearm is inoperable. FIGS. 10A-10C illustrate the first state. FIGS. 11A and 11B illustrate the firearms lock 1000 in the second state. According to the illustrated embodiment, the locking mechanism 1000 is a lamina emergent mechanism. That is, operation of the electromechanical operator 1030 causes the compliant mechanism 1024 to move in a direction orthogonal to the plane in which the mechanism 1024 is located along a z-axis into the page, referring to FIG. 11A. Operation of the electromechanical operator 1030 results in a force applied to the rigid member 1026 that overcomes the bias of the plurality of flexible members 1028A-D such that the rigid member moves in the direction of the force arrow F illustrated in FIG. 11B. The resulting displacement of the compliant mechanism causes the rigid member 1026 to move outside the plane of the trigger bar 1020, 1022 as illustrated in FIGS. 11A-B. When the trigger is pulled the resulting motion is transferred from the front trigger bar 1022 to the plurality of flexible members 1028A-D such that the displacement moves the rigid portion 1026 but not the rear trigger bar.

Figure 12A:
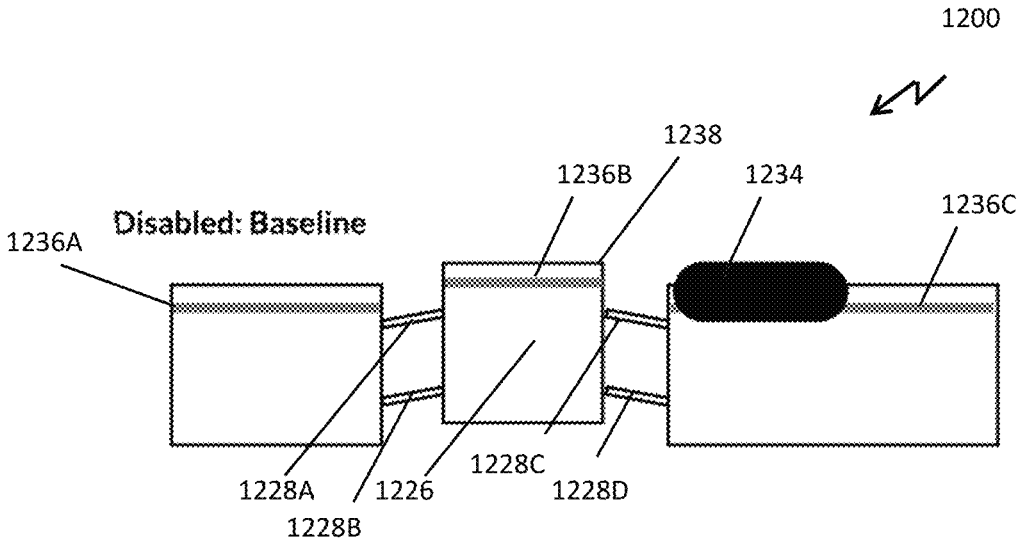
FIGS. 12A-12C illustrate a locking mechanism in accordance with an alternate embodiment.
Figure 12B:
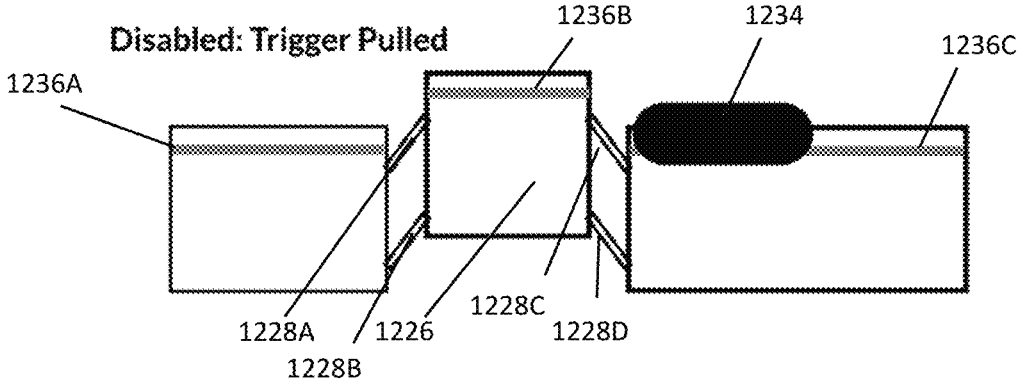
Figure 12C:
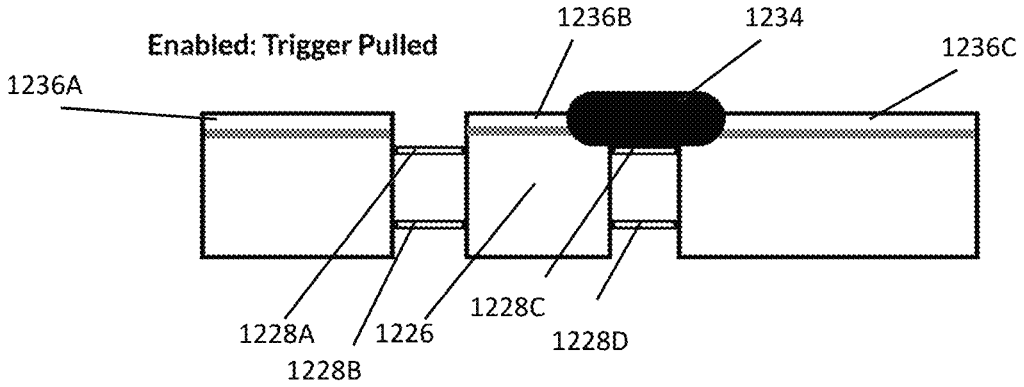

Referring now to FIGS. 12A-12C, a locking mechanism 1200 is illustrated in accordance with another embodiment. FIGS. 12A-12C illustrate the locking mechanism 1200 in three operating states: a first state in which the locking mechanism disables the firing mechanism and the trigger is not pulled; a second state in which the firing mechanism is disabled and the trigger is pulled; and a third state in which the trigger is pulled with the locking mechanism unlocked such that the firearm is operational, respectively.

According to the illustrated embodiment, the locking mechanism 1200 is a compliant member included in a trigger bar. The locking mechanism 1200 includes a rigid member 1226, a plurality of flexible members 1228A-1228D, a travelling member 1234 and a set of grooves including a first groove 1236A, a second groove 1236B and a third groove 1236C. The rigid member 1226 includes an engagement surface 1238. In the illustrated embodiment, the rigid member 1226 in combination with the plurality of flexible members 1228A-1228D connects a rear portion of the trigger bar to a front portion of the trigger bar. As is discussed further in the below-description, the actuators employed with the locking mechanism are not illustrated. In general, however, an actuator is coupled to the travelling member 1234. In some embodiments, the engagement surface includes a slope along the upper edge of the rigid member to allow the travelling member to more easily move from the position shown in FIG. 12A to the position shown in FIG. 12C.

In some embodiments, the traveling member 1234 is moved linearly between the unlocked position illustrated in FIG. 12C and the locked position illustrated in FIGS. 12A-B using an actuator connected to the travelling member 1234. Depending on the embodiment, the actuator can include any of a linear actuator, a rotary actuator, a solenoid or a MEMS device, as some examples. In some embodiments, the travelling member 1234 engages one or more of the grooves 1236A-1236C, respectively. According to these embodiments, the grooves 1236A-1236C maintain the travelling member in the proper orientation throughout its range of travel.

With the locking mechanism 1200 locked as illustrated in FIG. 12A, the plurality of flexible elements 1228A-D are biased such that the rigid member 1226 is predisposed to travel upward but in the same plane as the trigger bar. With the locking mechanism 1200 in a locked state and the trigger pulled as illustrated in FIG. 12B, the front portion of the trigger bar is moved toward the rearward portion of the trigger bar. With the locking mechanism 1200 locked, this motion is translated to an upward displacement of the rigid member 1226 as illustrated in FIG. 12B. However, with the locking mechanism unlocked, see FIG. 12C, the travelling member maintains the rigid member 1226 aligned with the adjacent portions of the trigger bar. Thus, in the unlocked state, the trigger pull is translated to motion in the remainder of the trigger bar.

While FIGS. 10A-12C illustrate the locking mechanisms 1000, 1200 integral to a trigger bar, the compliant mechanism may be included in another element of the overall firearm operating mechanism. That is, the locking mechanisms 1000, 1200 can be included in another element that links the trigger to the firing pin. For example, the locking mechanism can include a compliant mechanism located in series in the mechanical elements that link the trigger to the firing pin. Thus, depending on the embodiment, the locking mechanism 1000, 1200 including the compliant mechanism can be included in any of the trigger itself, the trigger bar, a disconnector, a hammer, a safety or the firing pin itself. In any of these embodiments, an electrically operated element can bias the compliant mechanism from a first state to a second state to render the firearm operating mechanism inoperative. In some embodiments, the electrically operated compliant mechanism is located in series in the linkage between a portion of the trigger that the user's finger engages and the firing pin. In one embodiment, the electrically operated element biases the compliant mechanism to place the firearm in the operative state.

According to some embodiments, one or more elements of an overall system as described herein can be provided in hardware or software included in a mobile device, for example, a tablet computer or smartphone. According to one version, at least a portion of the system is provided in a mobile app, for example, an app that receives feedback from the electronic trigger lock system 104 or the electronic apparatus 630.

It will be apparent to one of ordinary skill in the art based on the disclosure herein that the terms "trigger lock," "firearm locking mechanism" and "mechanical firearms lock" can refer to an apparatus that blocks, restrains, disengages or otherwise modifies any part of the linkage or mechanism that transfers a trigger-pull into an operation of a firing pin. Thus, a firearms locking mechanism or mechanical firearms lock may directly engage the trigger of the firearm or may not do so depending on the embodiment. According to one embodiment, the trigger bar is modified.

While the electronic systems are primarily illustrated and described with reference to a semi-automatic pistol herein, the approaches described herein can be employed with other styles and types of firearms. For example, the electronic systems 104, 600 can be employed with revolvers, rifles, shotguns and any other type of firearm that employs a trigger. The approaches described herein can also be employed in BB guns, pellet guns and AIRSOFT guns as some other examples. Further, while the embodiments illustrated and described herein refer to a motor operated as a generator to generate electricity, other power generation devices can be employed depending on the embodiment.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A locking mechanism configured to render a firearm inoperable, the firearm including a firearm operating mechanism that couples a trigger to firing pin included in the firearm, the locking mechanism comprising:

a compliant mechanism coupled to the firearm operating mechanism, the compliant mechanism operable in at least a first state and a second state when coupled to the firearm operating mechanism, wherein with the compliant mechanism in the first state, the compliant mechanism is positioned in an aligned position to travel axially as a part of the firearm operating mechanism such that the firearm will fire in response to a trigger pull; and wherein with the compliant mechanism in the second state the compliant mechanism is displaced to an unaligned position when the trigger is pulled such that the trigger pull is incapable of firing the firearm with the compliant mechanism in the second state.

2. The locking mechanism of claim 1, wherein the firearm operating mechanism includes a trigger bar, and wherein the compliant mechanism is included in the trigger bar.

3. The locking mechanism of claim 1, further comprising an electronic system coupled to the compliant mechanism and configured to respond to a wireless signal, wherein the electronic system operates to place the compliant mechanism in the second state in response to the wireless signal indicting that the firearm should be rendered inoperable.

4. The locking mechanism of claim 3, wherein the electronic system includes at least one of an inertial navigation system, a system in communication with a satellite-based positioning system and a system for triangulation via a cellular network, and wherein the wireless signal is received as a result of geographic location of the firearm.

5. The locking mechanism of claim 1, wherein the compliant mechanism is included in an element of the firearm operating mechanism that travels in a first direction, and wherein the compliant mechanism includes a rigid member configured to operate in a direction orthogonal to the first direction.

6. The locking mechanism of claim 5, further comprising a plurality of flexible members coupling the rigid member to the firearm operating mechanism.

7. The locking member of claim 5, wherein the rigid member is configured to travel in a plane common to a plane in which the element of the firearm operating mechanism travels.

8. The locking member of claim 5, further comprising a traveling member moveable between a first position configured to prevent a movement of the rigid member and a second position in which the rigid member is free to operate in the direction orthogonal to the first direction.

9. The locking member of claim 8, further comprising an actuator configured to move the traveling member from the first position to the second position.

10. The locking member of claim 9, wherein the actuator includes at least one of a linear actuator, a rotary actuator, a solenoid, a motor and a MEMS device.

11. The locking mechanism of claim 8, wherein an operation of the actuator is controlled in response to location-based information.

12. The locking mechanism of claim 3, wherein the electronic system includes:

a processor configured to process information provided by the wireless signal; and a locking mechanism controller coupled to the processor.

13. The locking mechanism of claim 12, further comprising a location positioning system configured to provide information employed to identify a location of the firearm, the location positioning system in communication with the processor, wherein the wireless signal includes a locking signal, and wherein the locking mechanism controller operates to place the compliant mechanism in the second state following a processing of the locking signal by the processor.

14. The locking mechanism of claim 13, wherein the compliant mechanism is included in an element of the firearm operating mechanism that travels in a first direction, and wherein the compliant mechanism includes a rigid member configured to operate in a direction orthogonal to the first direction.

15. The locking mechanism of claim 14, further comprising at least one flexible member coupling the rigid member to the firearm operating mechanism.

16. The locking member of claim 15, wherein the rigid member is configured to travel in a plane common to a plane in which the element of the firearm operating mechanism travels.

17. The locking member of claim 16, further comprising a traveling member moveable between a first position configured to prevent a movement of the rigid member and a second position in which the rigid member is free to operate in the direction orthogonal to the first direction.

* * * * *